US011141329B2

(12) United States Patent
Saito

(10) Patent No.: US 11,141,329 B2
(45) Date of Patent: Oct. 12, 2021

(54) SINGLE-HANDEDLY OPERABLE WHEELCHAIR

(71) Applicant: RESEARCH INSTITUTE FOR LIFE SPACE, LLC, Sapporo (JP)

(72) Inventor: Toru Saito, Sapporo (JP)

(73) Assignee: RESEARCH INSTITUTE FOR LIFE SPACE, LLC

( * ) Notice: Subject to any disclaimer, the term of this patent is extended or adjusted under 35 U.S.C. 154(b) by 0 days.

(21) Appl. No.: 16/953,332

(22) Filed: Nov. 20, 2020

(65) Prior Publication Data

US 2021/0161740 A1 Jun. 3, 2021

(30) Foreign Application Priority Data

Nov. 29, 2019 (JP) ..... JP2019-216235

(51) Int. Cl.
*A61G 5/02* (2006.01)

(52) U.S. Cl.
CPC ..... *A61G 5/028* (2013.01)

(58) Field of Classification Search
CPC ..... A61G 5/028; A61G 5/021; A61G 5/024; A61G 5/025; A61G 5/026
USPC ..... 280/250.1, 242.1, 247, 249
See application file for complete search history.

(56) References Cited

U.S. PATENT DOCUMENTS 3,899,189 A * 8/1975 Watkins ..... B62M 1/14 280/211
3,917,311 A * 11/1975 Wada ..... A61G 5/025 280/238
4,758,013 A * 7/1988 Agrillo ..... A61G 5/023 192/94
5,197,750 A * 3/1993 DiGeorge ..... A61G 5/02 188/2 F
5,306,035 A * 4/1994 Counts ..... A61G 5/02 280/250.1
5,482,305 A * 1/1996 Jeffries ..... A61G 5/023 280/250.1
5,846,154 A * 12/1998 Godin ..... A61G 5/02 475/331

(Continued)

FOREIGN PATENT DOCUMENTS

CN 108324446 A * 7/2018
CN 108757843 A * 11/2018

(Continued)

*Primary Examiner* — Minnah L Seoh
*Assistant Examiner* — Myles A Harris
(74) *Attorney, Agent, or Firm* — Yokoi & Co., U.S.A.; Toshiyuki Yokoi

(57) ABSTRACT

Provided is a lightweight and inexpensive wheelchair that can be easily operated with either a right or left hand. The wheelchair according to the present invention is provided with; a pair of handrims having a first portion connected to each handrim spoke and a second portion connected to a base of each wheel; a drive mechanism for transmitting a first rotational force generated by the first portion on one side and/or another side to the wheel on the one side and the wheel on the other side, wherein the drive mechanism includes an axle on the one side, an axle on the other side connected to the axle on the one side via a rotary shaft, a first two-way clutch located on the axle on the one side, and a second two-way clutch located on the axle on the other side.

6 Claims, 15 Drawing Sheets

(56) References Cited

U.S. PATENT DOCUMENTS 5,988,661 A * 11/1999 Garfinkle ..... A61G 5/025 280/242.1
6,017,046 A * 1/2000 Markovic ..... A61G 5/023 192/215
6,155,367 A * 12/2000 Alber ..... A61G 5/048 180/65.51
6,247,715 B1 * 6/2001 Korosue ..... A61G 5/023 280/242.1
6,247,716 B1 * 6/2001 Sato ..... A61G 5/04 180/6.48
6,755,430 B1 * 6/2004 Watwood ..... A61G 5/023 280/246
6,893,035 B2 * 5/2005 Watwood ..... A61G 5/023 280/242.1
7,225,910 B2 * 6/2007 Henriksson ..... A61G 5/02 192/19
7,959,176 B2 * 6/2011 Bidwell ..... A61G 5/0825 280/250.1
8,960,712 B2 * 2/2015 Kanno ..... H02K 11/215 280/647
8,991,532 B2 * 3/2015 Wei ..... A61G 5/047 180/65.51
9,370,454 B1 * 6/2016 Parker ..... A61G 5/025
10,857,048 B2 * 12/2020 You ..... A61G 5/1027
2008/0111338 A1 * 5/2008 Ilan ..... A61G 5/128 280/250.1
2013/0082512 A1 * 4/2013 Daigle ..... A61G 5/1083 301/6.5
2013/0277940 A1 * 10/2013 Nasser ..... A61G 5/021 280/238
2013/0307244 A1 * 11/2013 Garcia Franca ..... A61G 5/022 280/237
2014/0232085 A1 * 8/2014 Hsiao-Wecksler ..... A61G 5/02 280/250.1
2015/0202101 A1 * 7/2015 Louis ..... A61G 5/028 280/250.1
2016/0242976 A1 * 8/2016 Daigle ..... A61G 5/022
2017/0049644 A1 * 2/2017 Didner ..... A61G 5/023
2017/0151108 A1 * 6/2017 Pick ..... A61G 5/026
2018/0318156 A1 * 11/2018 Robins ..... A61G 5/023
2020/0214915 A1 * 7/2020 Saito ..... F16H 48/10
2021/0169715 A1 * 6/2021 Gallois ..... A61G 5/028

FOREIGN PATENT DOCUMENTS

EP 1941855 A1 * 7/2008 ..... A61G 5/028
ES 2394697 A1 * 2/2013
FR 2846226 A1 * 4/2004 ..... B62M 11/145
GB 2339743 A * 2/2000 ..... A61G 5/025
GB 2359529 A * 8/2001 ..... A61G 5/028
GB 2460065 A * 11/2009 ..... A61G 5/028
JP S46-13386 U 5/1971
JP 2004-141452 A 5/2004
JP 2006-55630 A 3/2006
JP 2010-279666 A 12/2010
JP 5105256 B 12/2012
JP 6288746 B 3/2018
JP 2020011027 A * 1/2020
JP 2020011029 A * 1/2020
KR 20020057608 A * 7/2002
KR 100385440 B1 * 5/2003
KR 20130059789 A * 6/2013
WO WO-2014024008 A1 * 2/2014 ..... A61G 5/023
WO WO-2020017103 A1 * 1/2020 ..... F16D 27/112
WO WO-2020017104 A1 * 1/2020 ..... A61G 5/02
WO WO-2020017250 A1 * 1/2020 ..... A61G 5/02

* cited by examiner

SINGLE-HANDEDLY OPERABLE WHEELCHAIR

CROSS-REFERENCES TO RELATED APPLICATIONS

This patent specification is based on Japanese patent application, No. 2019-216235 filed on Nov. 29, 2019, in the Japan Patent Office, the entire contents of which are incorporated by reference herein.

BACKGROUND OF THE INVENTION

1. Field of the Invention

The present invention generally relates to a manual wheelchair (hereinafter, simply referred to as a "wheelchair"). More specifically, the present invention relates to a lightweight and inexpensive wheelchair that can be easily operated by either a right or left hand.

2. Description of Related Art

A wheelchair is configured so that a wheelchair user (hereinafter, simply referred to as a "user") operates right and left wheels by his/her hand to move forward, backward, right turn, and left turn. However, it is difficult for a person with a disability on either the right or left side of the body to use a general wheelchair because they cannot use both hands freely. Therefore, a single-hand-operated wheelchair that can be operated with only a healthy hand, even if the right or left body is disabled, has been proposed (see Patent Document 1). The wheelchair described in Patent Document 1 is configured such that the wheelchair disposes a double handrim outside a wheel on a side, where a healthy half of the body of a user is located so that the movement of the wheelchair can be controlled by operating the handrim with the healthy hand.

On the other hand, a wheelchair has also been proposed in which a rotary shaft connecting right and left wheels and an operating device such as a lever and a clutch are interlocked, and these operating devices are operated by a single hand to control the wheelchair as desired (see Patent Documents 2 to 4). Further, the wheelchair described in Patent Document 5 was developed by the present inventor and has a feature that it can be easily operated by either a right or left hand.

Patent Document 1: Japanese Examined Utility Model Application Publication No. 46-13386

Patent Document 2: Japanese Unexamined Patent Application Publication No. 2004-141452

Patent Document 3: Japanese Unexamined Patent Application Publication No. 2010-279666

Patent Document 4: Japanese Patent No. 5105256

Patent Document 5: Japanese Patent No. 6288746

BRIEF SUMMARY OF THE INVENTION

However, the wheelchair described in Patent Document 1 is not convenient for wheelchair users, because handrim for operation is disposed on only one side of the right and left sides, and the operable side is predetermined. For this reason, there is an issue that two types of operation, both right and left, have to be manufactured, which contributes to high cost. Further, the wheelchair described in Patent Document 2 requires the operation of a lever, and the wheelchair described in Patent Document 3 requires a user to tilt his/her body to the right or left during operation, which is a physical burden. There was an issue that the physical burden was excessive. Also, the wheelchair described in Patent Document 4 has an issue that the configuration corresponding to the constant speed movement is not shown, and the usability is not good. Therefore, there is a demand for a wheelchair that can be easily operated by a healthy hand for a person with a disability on either the right or left side of the body. Furthermore, although the wheelchair described in Patent Document 5 is fortunately well received, there has been a demand for a wheelchair that can be moved by easier operation, is lightweight, and is inexpensive.

The present invention has been developed given such a situation, and an objective of the present invention is to provide a lightweight and inexpensive wheelchair that can be easily operated by either a right or left hand.

According to claim 1 of the present application, the present invention provides a single-handedly operable wheelchair having a frame, a right wheel and a left wheel, a right caster and a left caster, a seat, and a pair of right and left circular cross-sectional handrims concentrically disposed with an axle of each wheel, the wheelchair including: each of the handrims formed as separate bodies, and having a first portion located at an inner lower portion of the circular cross-section and a second portion occupying a portion other than the first portion of the circular cross-section; the first portion connected to a handrim spoke; the second portion connected to a base of each wheel; and a drive mechanism for transmitting a first rotational force generated by the first portion of the handrim on one side and/or another side to the wheel on the one side and the wheel on the other side. A second rotational force generated by the second portion of the handrim on the one side and/or the other side is transmitted to the wheel on the corresponding side. The drive mechanism has the axle on the one side connected to the handrim spoke on the one side, the axle on the other side connected to the axle on the one side via a rotary shaft and connected to the handrim spoke on the other side, a first two-way clutch disposed on the axle on the one side, and a second two-way clutch disposed on the axle on the other side. The first two-way clutch is configured to transmit the first rotational force to the wheel on the one side and is not configured to transmit the second rotational force generated by the second portion of the handrim on the one side to the axle on the one side. Further, the second two-way clutch is configured to transmit the first rotational force to the wheel on the other side and is not configured to transmit the second rotational force generated by the second portion of the handrim on the other side to the axle on the other side.

According to claim 2 of the present application, the present invention provides a single-handedly operable wheelchair having a frame, a right wheel and a left wheel, a right caster and a left caster, a seat, and a pair of right and left circular cross-sectional handrims concentrically disposed with an axle of each wheel, the wheelchair including: each of the handrims formed as separate bodies, and having a first portion located at an inner lower portion of the circular cross-section and a second portion occupying a portion other than the first portion of the circular cross-section; the first portion connected to a handrim spoke; the second portion connected to a base of each wheel; and a drive mechanism for transmitting a first rotational force generated by the first portion of the handrim on one side and/or another side to the wheel on the one side and the wheel on the other side. A second rotational force generated by the second portion of the handrim on the one side and/or the other side is transmitted to the wheel on the corresponding side. The drive mechanism has the axle on the one side connected to the handrim spoke on the one side, the axle on the other side connected to the axle on the one side via a rotary shaft and connected to the handrim spoke on the other side, a first one-way clutch disposed on the axle on the one side, and a second one-way clutch disposed on the axle on the other side. The first one-way clutch is configured to transmit only the forward rotational force of the first rotational force to the wheel on the one side and is configured to transmit only the backward rotational force of the second rotational force generated by the second portion of the handrim on the one side to the axle on the one side. Further, the second one-way clutch is configured to transmit only the forward rotational force of the first rotational force to the wheel on the other side and is configured to transmit only the backward rotational force of the second rotational force generated by the second portion of the handrim on the other side to the axle on the other side.

According to claim 3 of the present application, regarding the wheelchair of claim 1, the present invention provides the single-handedly operable wheelchair, wherein an idling mechanism for adjusting a rotational play generated during the use of the first two-way clutch and/or the second two-way clutch is provided. The idling mechanism has a third portion disposed as a separate body from the second portion at an outer upper portion of the circular cross-section of the handrim, and a plurality of roller structures disposed at predetermined intervals in a circumferential direction of the handrim. Further, the roller structure is composed of a shaft member and a roller rotatably attached to the shaft member and is housed in the space provided inside the third portion with the lower end of the roller in contact with the second portion and the shaft member fixed to the third portion.

According to claim 4 of the present application, regarding the wheelchair of claim 2, the present invention provides the single-handedly operable wheelchair, wherein an idling mechanism for adjusting a rotational play generated during the use of the first one-way clutch and/or the second one-way clutch is provided. The idling mechanism has a third portion disposed as a separate body from the second portion at an outer upper portion of a circular cross-section of the handrim, and a plurality of roller structures disposed at predetermined intervals in a circumferential direction of the handrim. Further, the roller structure is composed of a shaft member and a roller rotatably attached to the shaft member and is housed in the space provided inside the third portion with the lower end of the roller in contact with the second portion and the shaft member fixed to the third portion.

According to claim 5 of the present application, the present invention provides a single-handedly operable wheelchair having a frame, a right wheel and a left wheel, a right caster and a left caster, a seat, and a pair of right and left circular cross-sectional handrims concentrically disposed with an axle of each wheel, the wheelchair including: the handrim on one side formed as separate bodies, and having a first portion located at an inner lower portion of the circular cross-section and a second portion occupying a portion other than the first portion of the circular cross-section; the first portion and the handrim on another side connected to a handrim spoke; the second portion connected to a base of the wheel on the one side; and a drive mechanism for transmitting a first rotational force generated by the first portion of the handrim on the one side and/or by the handrim on the other side to the wheel on the one side and the wheel on the other side. A second rotational force generated by the second portion of the handrim on the one side is transmitted to the wheel on the one side. The drive mechanism has the axle on the one side connected to the handrim spoke on the one side, the axle on the other side connected to the axle on the one side via a rotary shaft and connected to the handrim spoke on the other side, a first one-way clutch disposed on the axle on the one side, and a second one-way clutch disposed on the axle on the other side. The first one-way clutch is configured to transmit only the forward rotational force of the first rotational force to the wheel on the one side and is configured to transmit only the backward rotational force of the second rotational force generated by the second portion of the handrim on the one side to the axle on the one side. Further, the second one-way clutch is configured to transmit only the forward rotational force of the first rotational force to the wheel on the other side.

According to claim 6 of the present application, regarding the wheelchair of claim 5, the present invention provides the single-handedly operable wheelchair, wherein an idling mechanism for adjusting a rotational play generated during the use of the first one-way clutch and/or the second one-way clutch is provided. The idling mechanism has a third portion disposed as a separate body from the second portion at an outer upper portion of a circular cross-section of the handrim, and a plurality of roller structures disposed at predetermined intervals in a circumferential direction of the handrim. Further, the roller structure is composed of a shaft member and a roller rotatably attached to the shaft member and is housed in the space provided inside the third portion with the lower end of the roller in contact with the second portion and the shaft member fixed to the third portion.

According to an embodiment of the present invention, there is provided a wheelchair capable of performing minimum necessary moving control by simple operation using only one hand. In the embodiment of the present invention, a handrim is divided into a plurality of portions, and it is not necessary to change the way of grasping the handrim so that it is easy to use. Further, by equipping an idling mechanism, a rotational play of a clutch can be adjusted and the wheelchair can be accurately controlled. Also, a wheelchair of a type for rehabilitation training is provided.

The wheelchair according to the embodiment of the present invention can even be used by anyone other than a person with a disability on either the right or left side of the body. That is, the wheelchair according to the embodiment of the present invention is useful when a person who has healthy both hands moves in the wheelchair with an article (smartphone, tableware, umbrella, or the like) in a single hand. It is also useful when playing sports such as tennis or basketball in a wheelchair. Further, as will be described in detail later, the wheelchair according to the embodiment of the present invention is useful compared to a conventional both-hands-wheelchair, in that it can be used for an uphill movement while resting according to the physical strength of the user.

BRIEF DESCRIPTION OF THE DRAWINGS

FIG. 12A is a view showing a right handrim provided a third portion, and FIG. 12B is a view taken along line 12*b*-12*b* of FIG. 12A. FIG. 12C is an enlarged view of a portion of 12*c* in FIG. 12B.

DETAILED DESCRIPTION OF THE INVENTION

Figure 1:
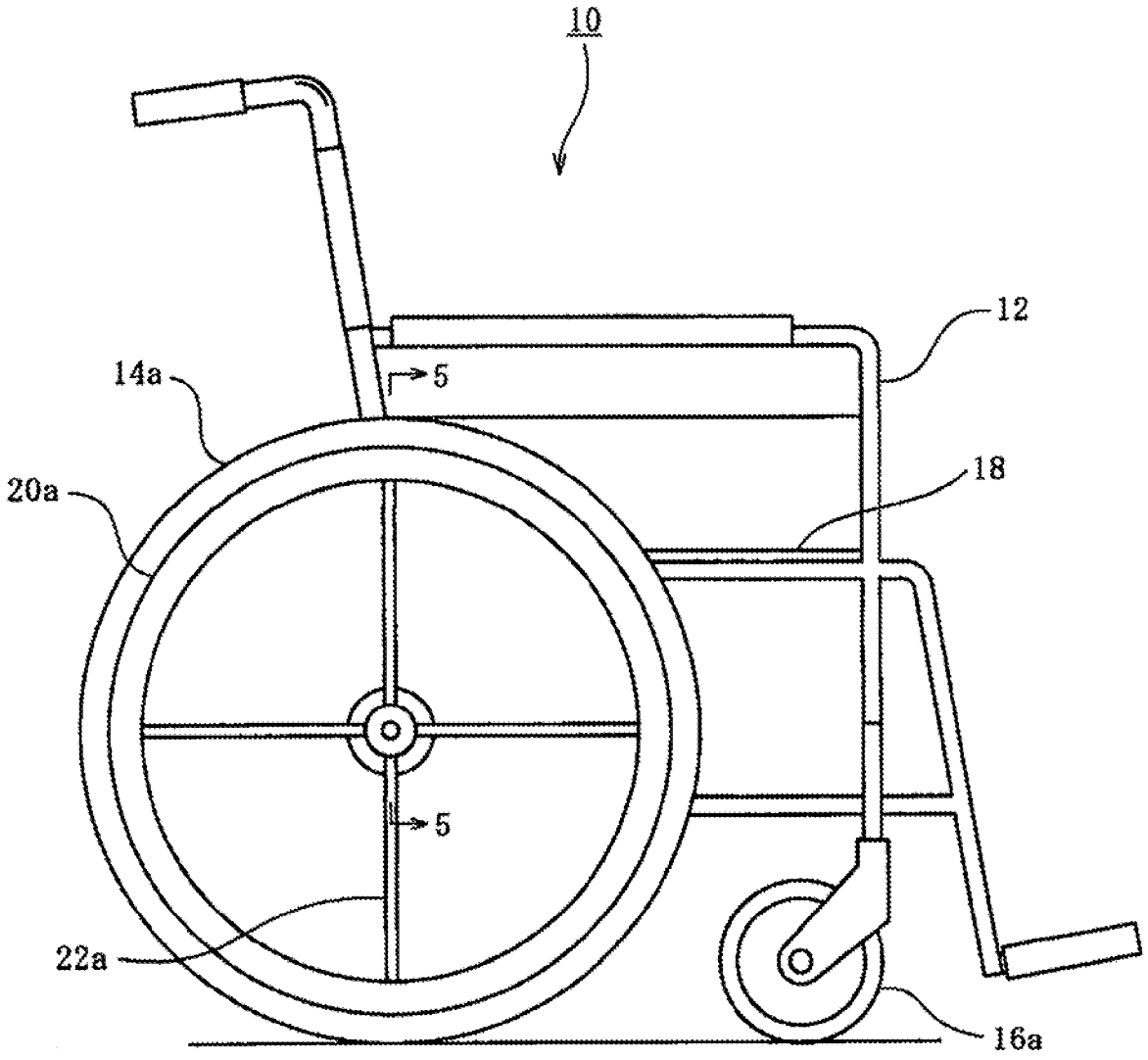
FIG. 1 is a right side view showing a wheelchair, according to an embodiment of the present invention.
Figure 2:
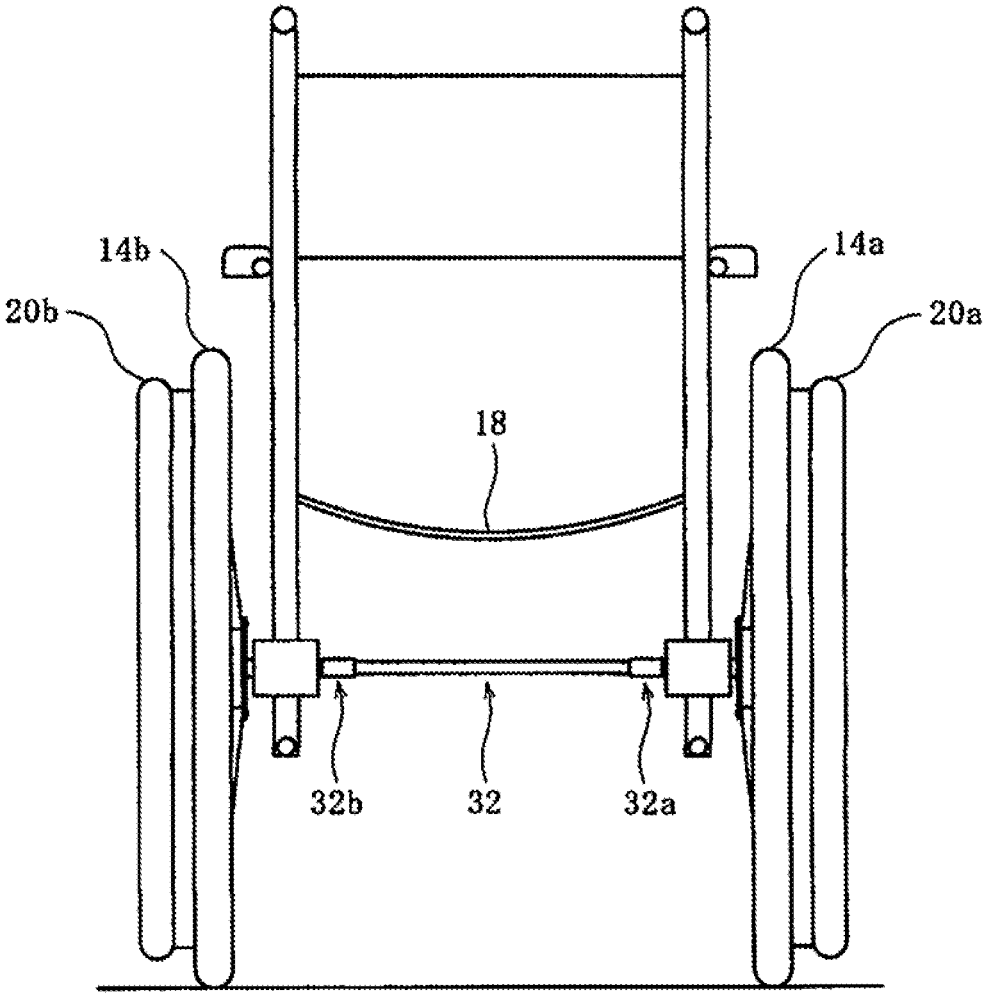
FIG. 2 is a rear view of the wheelchair of FIG. 1.

Next, a wheelchair, according to an embodiment of the present invention, will be described in detail with reference to the drawings. FIG. 1 is a right side view showing the wheelchair, according to the embodiment of the present invention. FIG. 2 is a rear view of the wheelchair shown in FIG. 1.

According to the embodiment of the present invention, as shown by a reference numeral 10 as a whole in FIG. 1, the wheelchair has a frame 12 forming a skeleton of the wheelchair, a right wheel 14*a* and a left wheel 14*b*, a pair of casters 16*a* and 16*b*, and a seat 18. The wheelchair 10 is symmetrical concerning its centerline, and has the same component on each of the right and left sides. In the following description, "a" is attached to the reference symbol of the component located on the right side of the wheelchair 10, and "b" is attached to the reference symbol of the component located on the left side of the wheelchair 10. Hereinafter, the configuration of the right side portion of the wheelchair 10 will be mainly described.

Figure 3A:
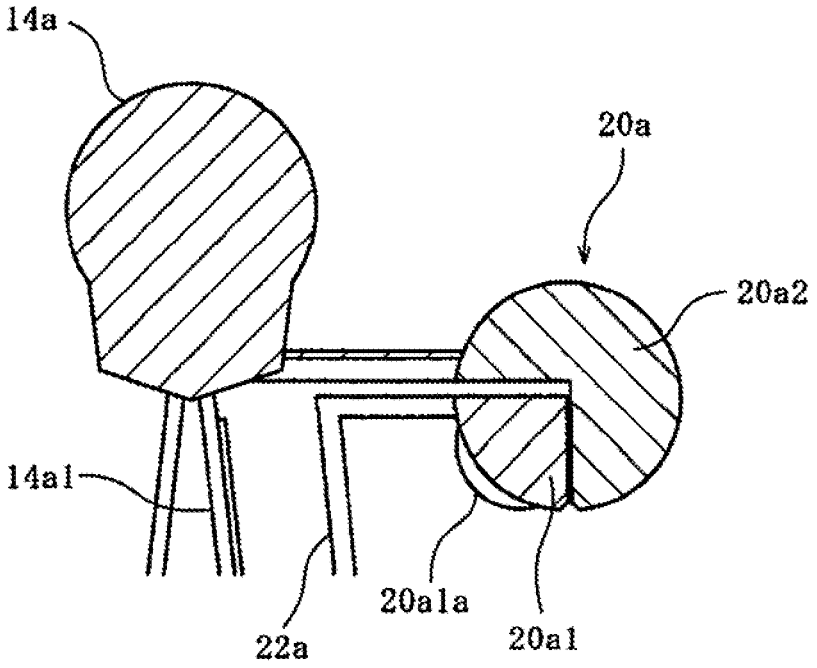
FIG. 3A is a view showing a cross-section of a handrim.

The wheelchair 10 also has a handrim 20*a* disposed concentrically of an axle 24*a* of the right wheel 14*a*. As shown in FIG. 3A, the handrim 20*a* has two portions, that is, a first portion 20*a*1 located at an inner lower portion of the circular cross-section, and a second portion 20*a*2 occupying a portion other than the first portion 20*a*1 of the circular cross-section. The first portion 20*a*1 and the second portion 20*a*2 are formed as separate bodies. As a result, when a user grasps the handrim 20*a*, fingertips of fingers other than a thumb come into contact with the first portion 20*a*1, and the thumb and palm come into contact with the second portion 20*a*2. The portion intended by the user (only the first portion 20*a*1, only the second portion 20*a*2, or both the first portion 20*a*1 and the second portion 20*a*2) can be operated. In the specification, "inward" means a side where the user sitting in the wheelchair is located, and "outward" means the opposite side to the side where the user is located.

Figure 3B:
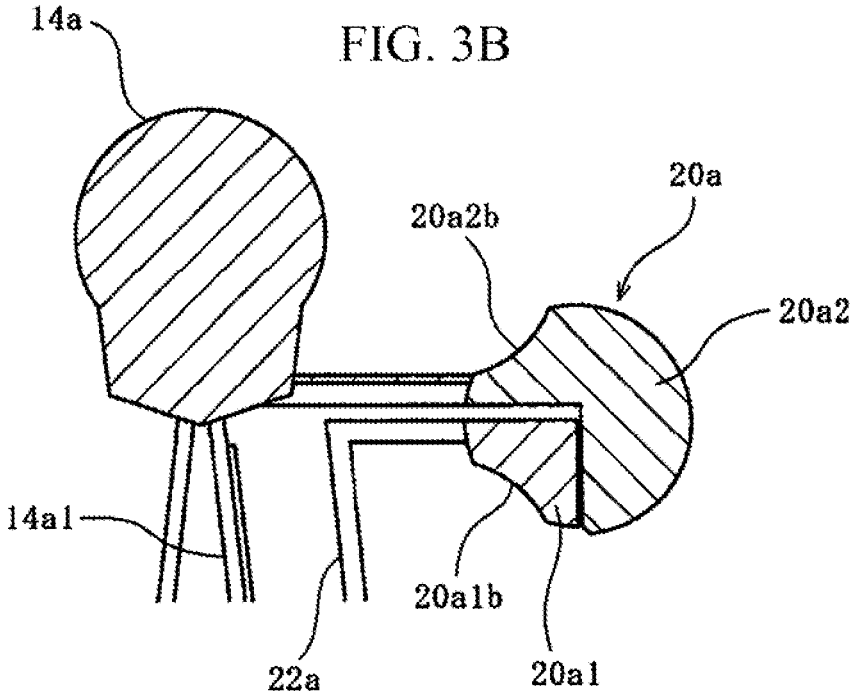
FIG. 3B is a view showing a cross-section of a handrim of another form.

As shown in FIG. 3A, a convex portion 20*a*1*a* is provided on the outer surface of the first portion 20*a*1 of the handrim 20*a* to improve the grip of the fingers. By providing the convex portion 20*a*1*a*, an effect that the user can easily recognize the first portion 20*a*1 with the finger can be expected. Instead of providing the convex portion 20*a*1*a*, as shown in FIG. 3B, a recess 20*a*1*b* may be provided on the outer surface of the first portion 20*a*1 of the handrim 20*a*. A recess 20*a*2*b* may also be provided on the outer surface of the second portion 20*a*2 of the handrim 20*a*. Similar to the convex portion 20*a*1*a*, the recess 20*a*1*b* and the recess 20*a*2*b* can be expected to have the effects of improving the grip strength of the fingers and making it easier for the user to recognize the first portion 20*a*1 and the second portion 20*a*2 with the fingers.

The first portion 20*a*1 of the handrim 20*a* is connected to a handrim spoke 22*a*, and the second portion 20*a*2 is connected to a base of the right wheel 14*a*.

Figure 4A:
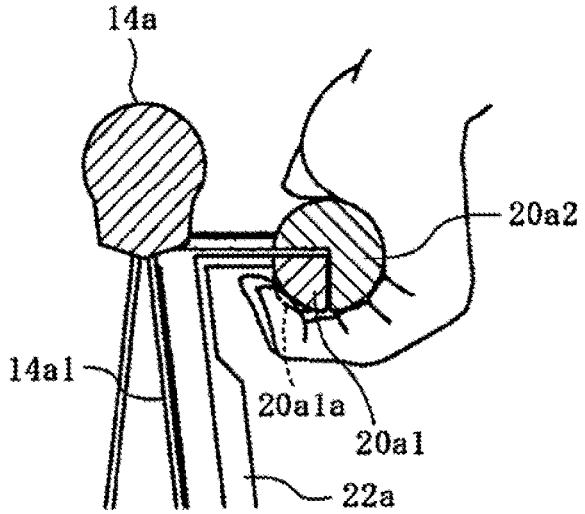
FIG. 4A is a view showing a state in which a first portion and a second portion of the handrim of FIG. 3A are grasped by the right hand.
Figure 4B:
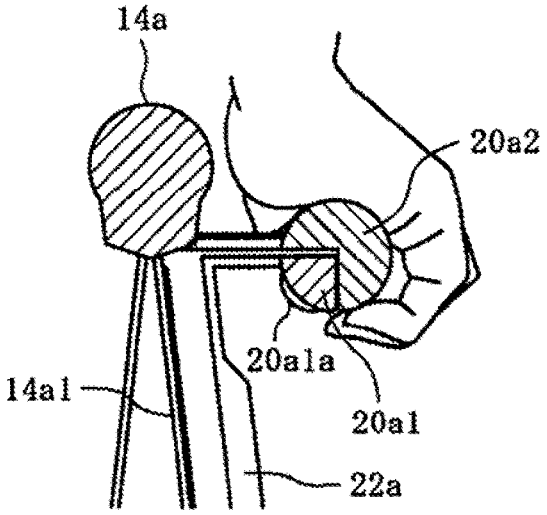
FIG. 4B is a view showing a state in which the second portion of the handrim of FIG. 3A is grasped by the right hand.
Figure 4C:
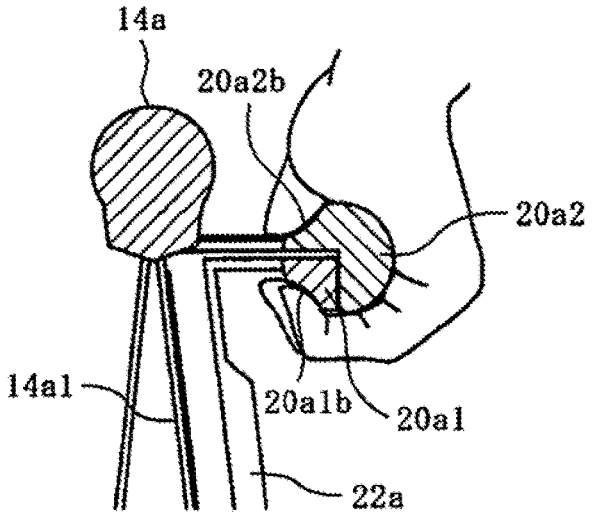
FIG. 4C is a view showing a state in which a first portion and a second portion of the handrim of FIG. 3B are grasped by the right hand.
Figure 4D:
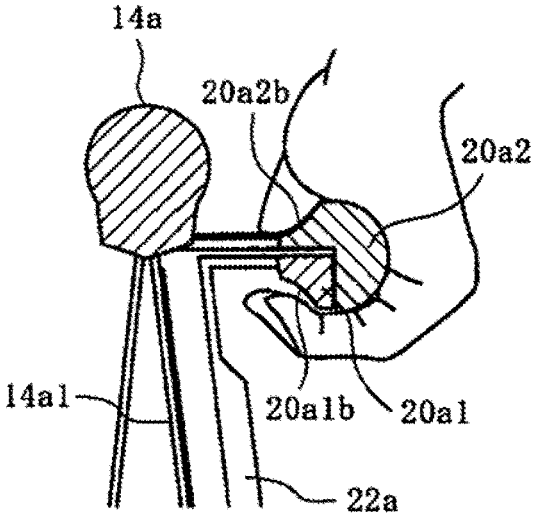
FIG. 4D is a view showing a state in which the second portion of the handrim of FIG. 3B is grasped by the right hand.

FIG. 4A shows a state in which the first portion 20*a*1 and the second portion 20*a*2 of the handrim 20*a* shown in FIG. 3A are grasped by the right hand, and FIG. 4B shows a state in which only the second portion 20*a*2 is grasped by the right hand. Moreover, FIG. 4C shows a state in which the first portion 20*a*1 and the second portion 20*a*2 of the handrim 20*a* shown in FIG. 3B are grasped by the right hand, and FIG. 4D shows a state in which only the second portion 20*a*2 is grasped by the right hand.

Figure 5:
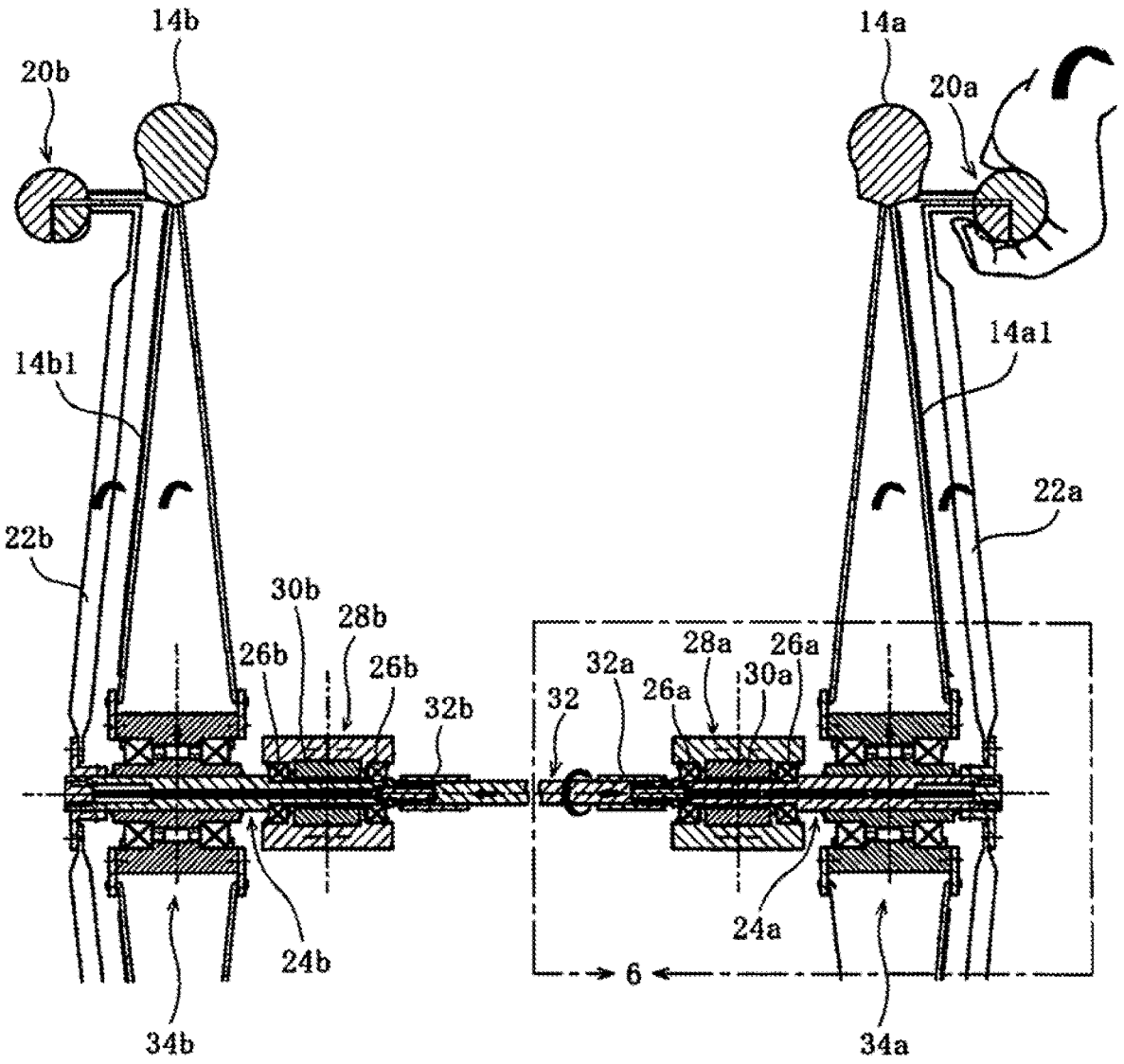
FIG. 5 is a cross-sectional view taken along line 5-5 of FIG. 1, showing a configuration of right and left drive mechanisms of the wheelchair.
Figure 6:
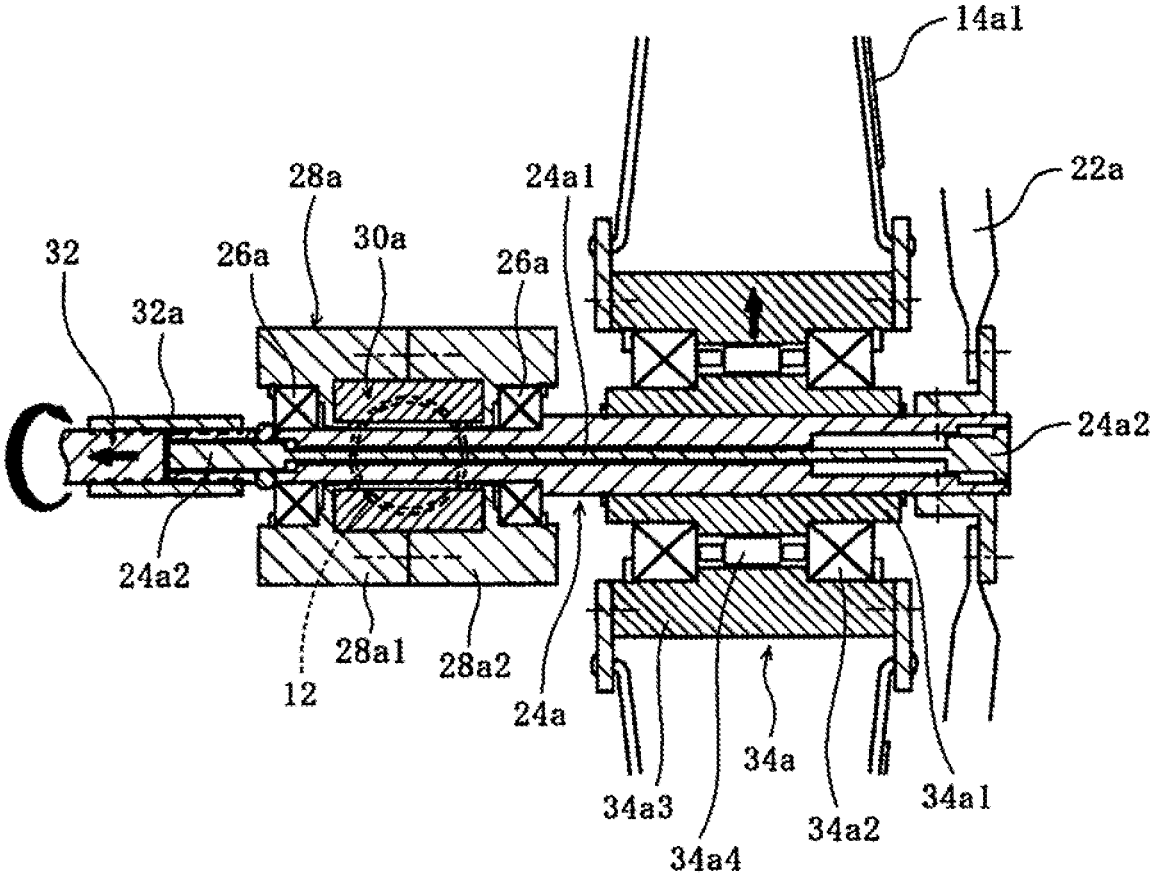
FIG. 6 is an enlarged cross-sectional view of a portion of 6 in FIG. 5.

Next, the configuration of right and left drive mechanisms of the wheelchair 10 will be described with reference to FIGS. 5 and 6. FIG. 5 is a cross-sectional view taken along line 5-5 of FIG. 1, and FIG. 6 is an enlarged cross-sectional view of a portion of 6 in FIG. 5. The wheelchair 10 includes the axle 24*a* that supports the right wheel 14*a*, and the axle 24*a* is mounted to the frame 12 via an axle holder 28*a* and a mounting boss 30*a*. The handrim spoke 22*a* is connected to the outer end of the axles 24*a*.

The axle 24*a* is rotatably supported in the axle holder 28*a* (and therefore the frame 12) by bearings 26*a*. Also, the left side portion of the wheelchair 10 is provided with an axle 24*b* having the same configuration at the corresponding location. The axle 24*a* and the axle 24*b* form one rotating shaft via a columnar rotary shaft 32 and connection sleeves 32*a*, 32*b*.

The axle holder 28*a* is configured to sandwich the mounting boss 30*a* of a conventional wheelchair by a pair of holder members 28*a*1 and 28*a*2 (see FIG. 6) each having the bearing 26*a* as a retrofit attachment to the conventional wheelchair. It is possible to replace wheels 14*a* and 14*b* with wheels of the present invention while keeping the conventional wheelchair frame as it is.

In FIG. 5, for convenience of drawing, the rotary shaft 32 is shown as being right and left separated, but in actuality, the rotary shaft 32 is formed of one cylindrical shaft. Further, the axle 24*a*, the rotary shaft 32, and the axle 24*b* may be integrally formed.

In FIGS. 5 and 6, the axles 24*a* and 24*b* are hollow, and a rod 24*a*1 provided with a raised portion 24*a*2 at both ends is inserted. The rod 24*a*1 is for releasably mounting the right wheel 14*a* to the frame 12. Such the configuration itself of the axle 24*a* is known and is not configured in the subject matter of the present invention.

Figure 7A:
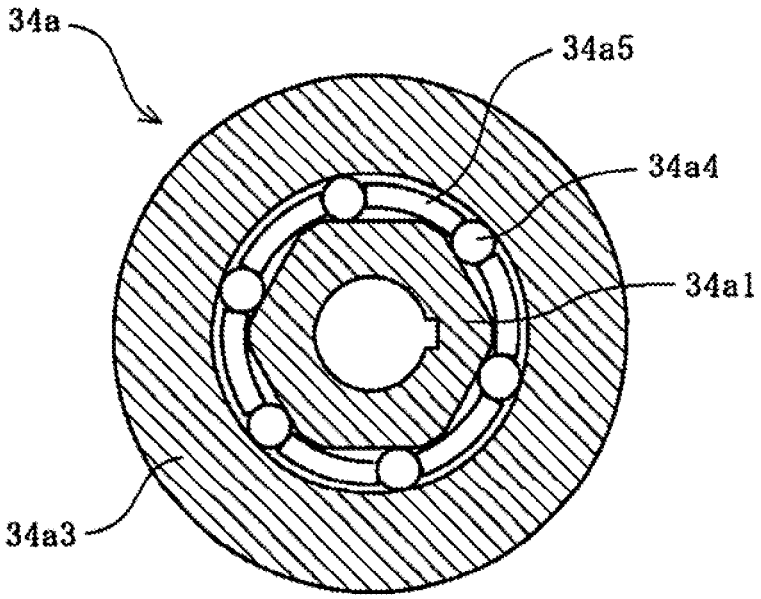
FIG. 7A is a view showing an example of a two-way clutch.

A two-way clutch 34*a* is attached to the axle 24*a* outside the axle holder 28*a*. Here, the two-way clutch 34*a* refers to a clutch that can transmit a rotational force in the same direction as the input when inputting to an inner ring 34*a*1 described later and cannot transmit a rotational force when inputting to an outer ring 34*a*3. The two-way clutch 34*a* includes the inner ring 34*a*1 of a regular polygon (a regular hexagon in the example shown in FIG. 7A) non-rotatably attached to the axle 24*a* outside the axle holder 28*a*, and the cylindrical outer ring 34*a*3 rotatably supported on the inner ring 34*a*1 by a bearing 34*a*2 in a state in which the outer ring 34*a*3 is spaced apart from the inner ring 34*a*1. The inner ring 34*a*1 is attached to the axle 24*a* by using a keyway (see FIG. 7A), press-fitting, or the like so as not to rotate. A rotation of the axle 24*a* in both directions (clockwise and counterclockwise) causes a rotation of the inner ring 34*a*1 in the same directions. Each side of the regular polygonal inner ring 34*a*1 is a cam surface, and one roller is provided in a gap between each side of the regular polygonal inner ring 34*a*1 and the outer ring 34*a*3, as shown in FIG. 7A. A cage 34*a*5 is arranged between the rollers 34*a*4, and the distance between the rollers 34*a*4 is maintained. The inner ring 34*a*1 serving as an input shaft or an output shaft is connected to the axle 24*a* attached to the handrim spoke 22*a*, and the outer ring 34*a*3 serving as an output shaft or an input shaft is connected to a wheel spoke 14*a*1 of the right wheel 14*a*.

Figure 7B:
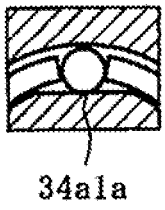
FIGS. 7B, 7C, 7D, 7E, and 7F are views showing an operating state of the two-way clutch.
Figure 7C:
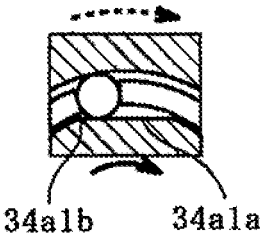
Figure 7D:
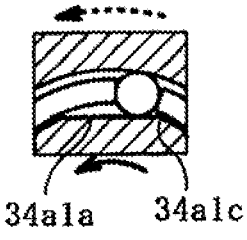
Figure 7E:
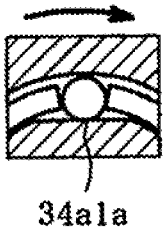
Figure 7F:
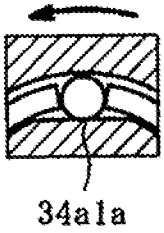

The operation of the two-way clutch 34*a* configured as described above will be described with reference to FIGS. 7B to 7F. A solid arrow indicates an input rotation, and a dashed arrow indicates an output rotation. The clockwise rotation of the inner ring 34*a*1 causes the movement of the roller from the middle portion of each side 34*a*1*a* of the inner ring 34*a*1 (see FIG. 7B) to a left end portion 34*a*1*b* of each side 34*a*1*a* (see FIG. 7C). (During that time, the rotation of the inner ring 34*a*1 does not cause the rotation of the outer ring 34*a*3.) Reaching the left end 34*a*1*b* of the roller 34*a*4 causes a lock on a rotation of the roller 34*a*4. The rotation of the inner ring 34*a*1 (see the solid arrow in FIG. 7C) causes a transmission to the outer ring 34*a*3 and causes the clockwise rotation of the outer ring 34*a*3 (see the dashed arrow in FIG. 7C). The counterclockwise rotation of the inner ring 34*a*1 causes the movement of the roller 34*a*4 from the middle portion of each side 34*a*1*a* of the inner ring 34*a*1 (see FIG. 7B) to a right end portion 34*a*1*c* of each side 34*a*1*a* (see FIG. 7D). (During that time, the rotation of the inner ring 34*a*1 does not cause the rotation of the outer ring 34*a*3.) Reaching the right end 34*a*1*c* of the roller 34*a*4 causes a lock on the rotation of the roller 34*a*4. The rotation of the inner ring 34*a*1 (see the solid arrow in FIG. 7D) causes the transmission to the outer ring 34*a*3 and causes the counterclockwise rotation of the outer ring 34*a*3 (see the dashed arrow in FIG. 7D). On the other hand, the clockwise rotation of the outer ring 34*a*3 (see the solid arrow in FIG. 7E) does not cause the transmission of the rotational force of the outer ring 34*a*3 to the inner ring 34*a*1 and does not cause the rotation of the inner ring 34*a*1, because the inner surface of the outer ring 34*a*3 is not a cam surface but a circular surface. Further, the counterclockwise rotation of the outer ring 34*a*3 (see the solid arrow in FIG. 7F) does not cause the transmission of the rotational force of the outer ring 34*a*3 to the inner ring 34*a*1 and does not cause the rotation of the inner ring 34*a*1, because the inner surface of the outer ring 34*a*3 is not a cam surface but a circular surface.

The configuration of the two-way clutch 34*a* as described above is known (for example, a two-way clutch manufactured by NTN Corporation). Further, if an input of an inner ring can cause a transmission of a rotational force of an outer ring in the same direction as the input, and the input of the outer ring cannot cause the transmission of the rotational force of the inner ring, a two-way clutch of another configuration may be adopted.

Figure 8A:
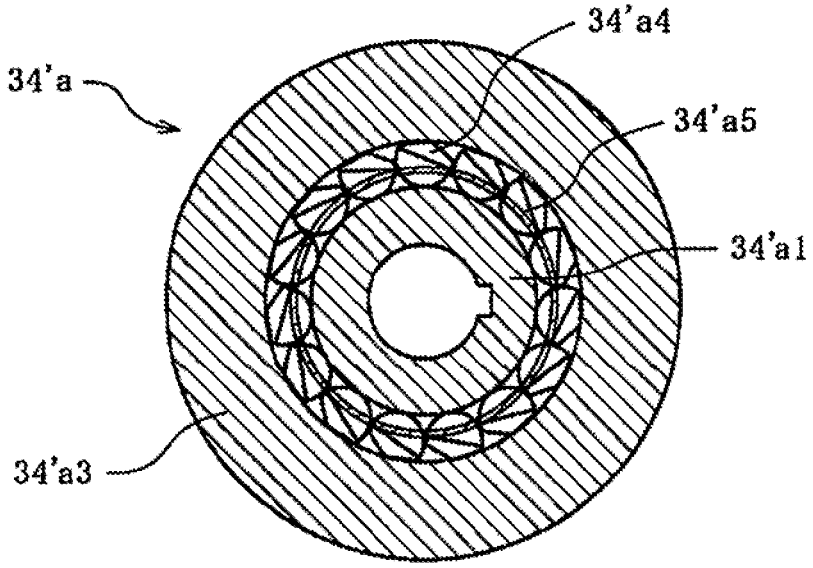
FIG. 8A is a view showing an example of a one-way clutch.
Figure 8B:
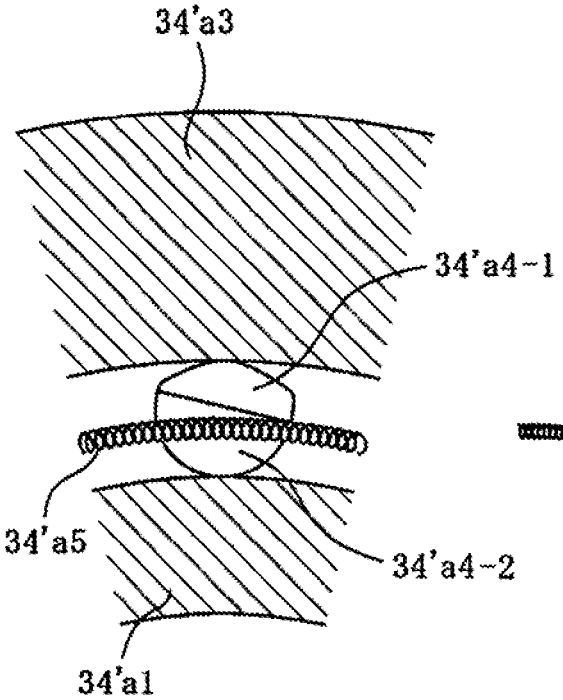
FIG. 8B is an enlarged view of a portion of the one-way clutch.
Figure 8C:
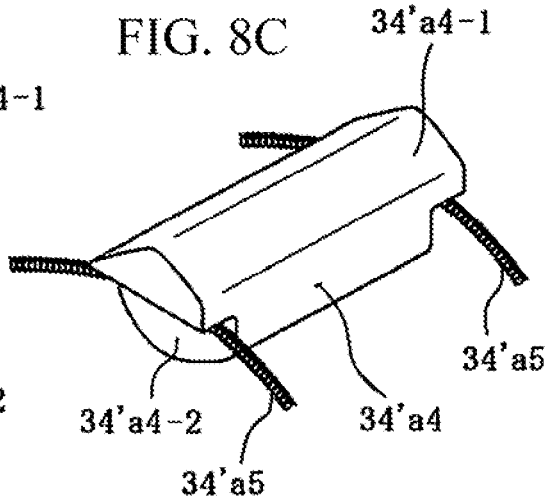
FIG. 8C is a cam of the one-way clutch.
Figure 8D:
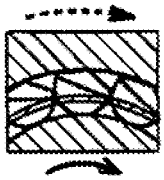
FIGS. 8D, 8E, 8F, and 8G are views showing an operating state of the one-way clutch.
Figure 8E:
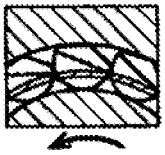
Figure 8F:
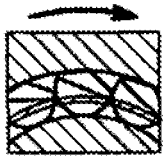
Figure 8G:
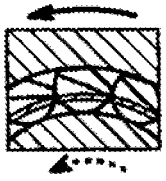

Instead of the two-way clutch 34*a*, a one-way clutch 34'*a* may be attached to the axle 24*a* outside the axle holder 28*a*. Here, the one-way clutch 34'*a* refers to a clutch that can transmit a rotational force only in one direction when inputting to an inner ring 34'*a*1 described later and can transmit a rotational force only in a direction opposite to the one direction when inputting to an outer ring 34'*a*3. As shown in FIG. 8A, the one-way clutch 34'*a* includes the cylindrical inner ring 34'*a*1 non-rotatably attached to the axle 24*a* outside the axle holder 28*a*, the cylindrical outer ring 34'*a*3 rotatably supported on the inner ring 34'*a*1 by a bearing 34'*a*2 in a state in which the outer ring 34'*a*3 is spaced apart from the inner ring 34'*a*1, and a large number of cams 34'*a*4 arranged between the inner ring 34'*a*1 and the outer ring 34'*a*3*a*. The inner ring 34'*a*1 is attached to the axle 24*a* by using a keyway (see FIG. 8A), press-fitting, or the like so as not to rotate. A rotation of the axle 24*a* in both directions (clockwise and counterclockwise) causes a rotation of the inner ring 34*a*'1 in the same directions. FIG. 8B is an enlarged view of a portion of FIG. 8A, and FIG. 8C is a perspective view showing the cam 34'*a*4 taken out. As shown in FIGS. 8B and 8C for the cam 34'*a*4, a cross-section of an upper half portion 34'*a*4-1 is formed into a curved convex shape, and a cross-section of a lower half portion 34'*a*4-2 is formed in a semicircular shape. The cam 34'*a*4 is always in contact with the outer circumference of the inner ring 34'*a*1 and the inner circumference of the outer ring 34'*a*3 by springs 34'*a*5 arranged at both ends of the cam 34'*a*4. The inner ring 34'*a*1 serving as an input shaft or an output shaft is connected to the axle 24*a* attached to the handrim spoke 22*a*, and the outer ring 34'*a*3 serving as an output shaft or an input shaft is connected to the wheel spoke 14*a*1 of the right wheel 14*a*.

The operation of the one-way clutch 34'*a* configured as described above will be described with reference to FIGS. 8D to 8G. In FIGS. 8D to 8G, a solid arrow indicates an input rotation, and a dashed arrow indicates an output rotation. A clockwise rotation of the inner ring 34'*a*1 (see the solid arrow in FIG. 8D) causes engagement with the cam 34'*a*4, the inner ring 34'*a*1, and the outer ring 34'*a*3. As a result, the clockwise rotation of the inner ring 34'*a*1 causes the transmission to the outer ring 34'*a*3, and causes a clockwise rotation of the outer ring 34'*a*3 (see the dashed arrow in FIG. 8D). The counterclockwise rotation of the inner ring 34'*a*1 (see the solid arrow in FIG. 8E) causes disengagement with the cam 34'*a*4, the inner ring 34'*a*1, and the outer ring 34'*a*3. As a result, the counterclockwise rotation of the inner ring 34'*a*1 does not cause the transmission to the outer ring 34'*a*3, and does not cause the rotation of the outer ring 34'*a*3. On the other hand, the clockwise rotation of the outer ring 34'*a*3 (solid arrow in FIG. 8F) causes disengagement with the cam 34'*a*4, the inner ring 34'*a*1, and the outer ring 34'*a*3. As a result, the clockwise rotation of the outer ring 34'*a*3 does not cause the transmission to the inner ring 34'a1, and does not cause the rotation of the inner ring 34'a1. The counterclockwise rotation of the outer ring 34'a3 (see the solid arrow in FIG. 8G) causes engagement with the cam 34'a4, the inner ring 34'a1, and the outer ring 34'a3. As a result, the counterclockwise rotation of the outer ring 34'a3 causes the transmission to the inner ring 34'a1, and causes the counterclockwise rotation of the inner ring 34'a1 (see the dashed arrow in FIG. 8G).

In the case of the one-way clutch 34'a, only one-way operation (usually forward operation) can be supported as compared to the two-way clutch 34a capable of both forward and backward operation, but the one-way clutch itself is cheaper than the two-way clutch and has the advantage of less rotational play. If the wheelchair 10 provided with the one-way clutches 34'a and 34'b is equipped with the idling mechanisms 36a and 36b described later, the effect of reducing the burden on the user's arm can be expected. Further, as will be described in detail later, by changing the two portions of the handrims 20a and 20b by the right and left hands, it is possible to comfortably perform an uphill movement.

The configuration of the one-way clutch 34'a as described above is known (for example, the cam clutch MZ-G series of Tsubakimoto Chain Co., Ltd.). Further, if an input of an inner ring can cause a transmission of a rotational force in only one direction, and an input of an outer ring can cause a transmission of a rotational force only in a direction opposite to one direction, a one-way clutch of another configuration may be adopted.

In the above description, the configuration of the right side portion of the wheelchair 10 has been mainly described, but the left side portion of the wheelchair 10 also has substantially the same configuration as the right side portion. That is, when describing the main components, 20b represents a handrim, 22b represents a handrim spoke, 24b represents an axle, 34b represents a two-way clutch, and 34'b represents a one-way clutch.

The operation of the wheelchair 10 provided with the two-way clutch 34a will be described with reference to FIGS. 9A to 9D. FIGS. 9A to 9D are schematic plan views showing a straight movement, a right-turn movement, or a left turn movement of the wheelchair 10.

Figure 9A:
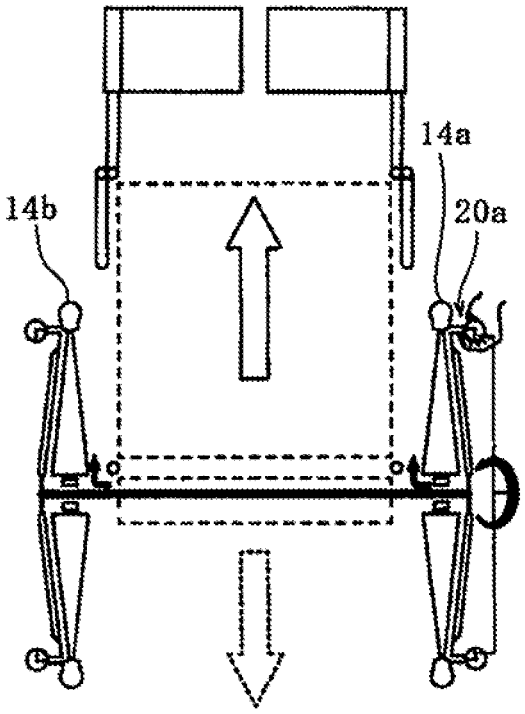
FIGS. 9A, 9B, 9C, and 9D are schematic views for explaining an operating state of the wheelchair.

When attempting to move forward by the right hand, both the first portion 20a1 and the second portion 20a2 of the handrim 20a are grasped by the right hand and rotated forward (see FIG. 9A). Then, a rotational force of the first portion 20a1 causes the transmission to the axle 24a, the two-way clutch 34a, the rotary shaft 32, the axle 24b, and the two-way clutch 34b via the handrim spoke 22a. After a rotational play of the two-way clutch 34a is eliminated, the rotational force of the first portion 20a1 causes the transmission to the outer ring 34a3 and causes the forward rotation of the right wheel 14a. Further, after a rotational play of the two-way clutch 34b is eliminated, the transmission of the rotational force of the first portion 20a1 to the outer ring 34b3 causes the forward rotation of the left wheel 14b. At the same time, the rotational force of the second portion 20a2 directly causes the transmission to the wheel (right wheel 14a) on the corresponding side and causes the forward rotation of the right wheel 14a. (At that time, the rotation of the outer ring 34a3 of the two-way clutch 34a does not cause the rotation of the inner ring 34a1.) The forward rotations of the right wheel 14a and the left wheel 14b cause the forward movement of the wheelchair 10. When attempting to move backward by the right hand, both the first portion 20a1 and the second portion 20a2 of the handrim 20a are grasped by the right hand and rotated backward. Then, the rotational force of the first portion 20a1 causes the transmission to the axle 24a, the two-way clutch 34a, the rotary shaft 32, the axle 24b, and the two-way clutch 34b via the handrim spoke 22a. After the rotational play of the two-way clutch 34a is eliminated, the rotational force of the first portion 20a1 causes the transmission to the outer ring 34a3 and causes the backward rotation of the right wheel 14a. Further, after the rotational play of the two-way clutch 34b is eliminated, the transmission of the rotational force of the first portion 20a1 to the outer ring 34b3 causes the backward rotation of the left wheel 14b. At the same time, the rotational force of the second portion 20a2 directly causes the transmission to the wheel (right wheel 14a) on the corresponding side and causes the backward rotation of the right wheel 14a. (At that time, the rotation of the outer ring 34a3 of the two-way clutch 34a does not cause the rotation of the inner ring 34a1.) The backward rotations of the right wheel 14a and the left wheel 14b cause the backward movement of the wheelchair 10 (see the dashed down arrow in FIG. 9A). Also, it is possible to move forward by both hands. In this case, both the first portion 20a1 and the second portion 20a2 of the handrim 20a are grasped by the right hand and rotated forward, and both the first portion 20b1 and the second portion 20b2 of the handrim 20b are grasped by the left hand and rotated forward.

Figure 9B:
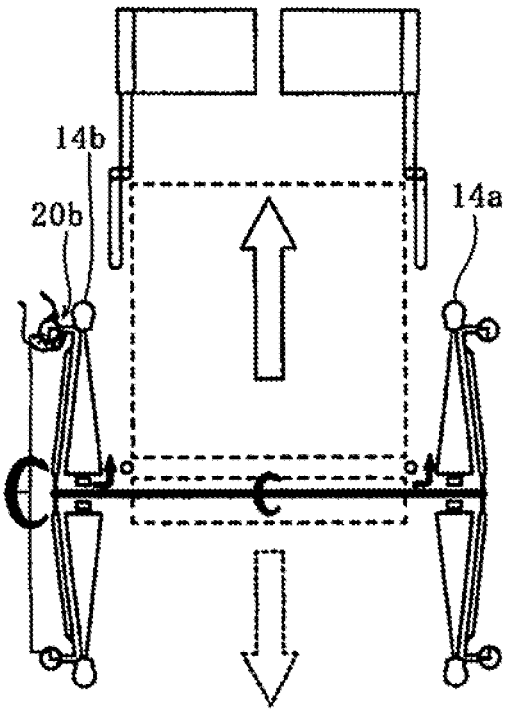

When attempting to move forward by the left hand, both the first portion 20b1 and the second portion 20b2 of the handrim 20b are grasped by the left hand and rotated forward (see FIG. 9B). Then, a rotational force of the first portion 20b1 causes the transmission to the axle 24b, the two-way clutch 34b, the rotary shaft 32, the axle 24a, and the two-way clutch 34a via the handrim spoke 22b. After the rotational play of the two-way clutch 34b is eliminated, the rotational force of the first portion 20b1 causes the transmission to the outer ring 34b3 and causes the forward rotation of the left wheel 14b. Further, after the rotational play of the two-way clutch 34a is eliminated, the transmission of the rotational force of the first portion 20b1 to the outer ring 34a3 causes the forward rotation of the right wheel 14a. At the same time, the rotational force of the second portion 20b2 directly causes the transmission to the wheel (left wheel 14b) on the corresponding side and causes the forward rotation of the left wheel 14b. (At that time, the rotation of the outer ring 34b3 of the two-way clutch 34b does not cause the rotation of the inner ring 34b1.) The wheelchair 10 moves forward. When attempting to move backward by the left hand, both the first portion 20b1 and the second portion 20b2 of the handrim 20b are grasped by the left hand and rotated backward. Then, the rotational force of the first portion 20b1 causes the transmission to the axle 24b, the two-way clutch 34b, the rotary shaft 32, the axle 24a, and the two-way clutch 34a via the handrim spoke 22b. After the rotational play of the two-way clutch 34b is eliminated, the rotational force of the first portion 20b1 causes the transmission to the outer ring 34b3 and causes the backward rotation of the left wheel 14b. Further, after the rotational play of the two-way clutch 34a is eliminated, the transmission of the rotational force of the first portion 20b1 to the outer ring 34a3 causes the backward rotation of the right wheel 14a. At the same time, the rotational force of the second portion 20b2 directly causes the transmission to the wheel (left wheel 14b) on the corresponding side and causes the backward rotation of the left wheel 14b. (At that time, the rotation of the outer ring 34b3 of the two-way clutch 34b does not cause the rotation of the inner ring 34b1.) The wheelchair 10 moves backward (See the dashed down arrow in FIG. 9B).

Figure 9C:
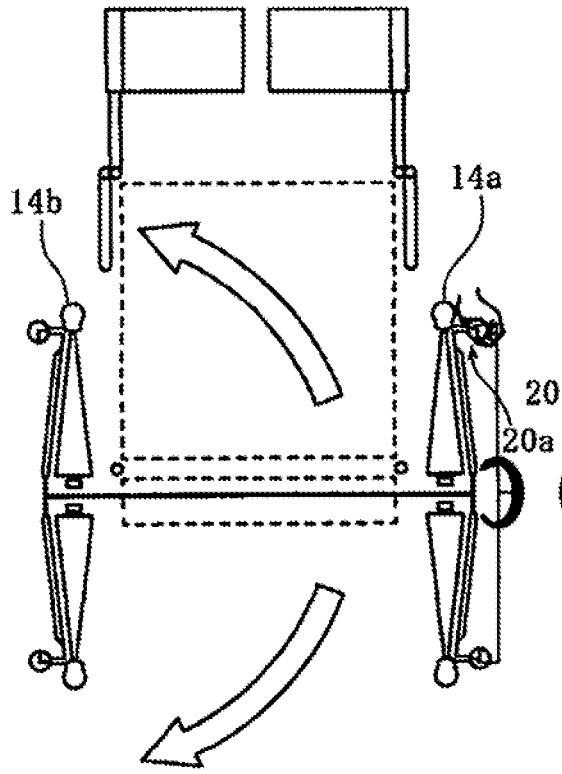

When attempting to turn left by the right hand, only the second portion 20*a*2 of the handrim 20*a* is grasped by the right hand and rotated forward (see FIG. 9C). Then, the rotational force of the second portion 20*a*2 directly causes the transmission of the wheel (right wheel 14*a*) on the corresponding side and causes the forward rotation of the right wheel 14*a*. (At that time, the rotation of the outer ring 34*a*3 of the two-way clutch 34*a* does not cause the rotation of the inner ring 34*a*1.) The rotation of the right wheel 14*a* with the left wheel 14*b* not rotating causes the left turn movement of the wheelchair 10. When attempting to turn right by the right hand, first, only the second portion 20*a*2 of the handrim 20*a* is grasped by the right hand and rotated backward (see FIG. 9C). Then, the rotational force of the second portion 20*a*2 directly causes the transmission of the wheel (right wheel 14*a*) on the corresponding side. (At that time, the rotation of the outer ring 34*a*3 of the two-way clutch 34*a* does not cause the rotation of the inner ring 34*a*1.) The backward rotation of the right wheel 14*a* causes the backward movement and a right turn movement of the wheelchair 10. Then, when both the first portion 20*a*1 and the second portion 20*a*2 of the handrim 20*a* are grasped and rotated forward by the right hand, the wheelchair 10 consequently turns right.

Figure 9D:
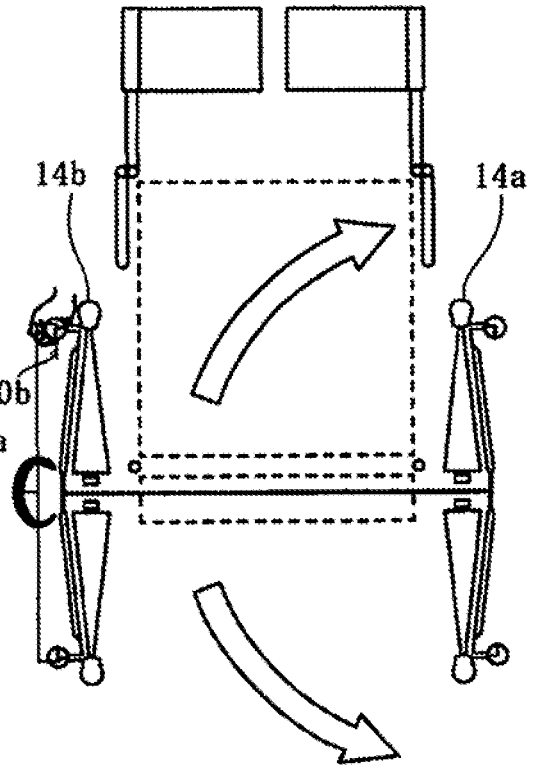

When attempting to turn right by the left hand, only the second portion 20*b*2 of the handrim 20*b* is grasped by the left hand and rotated forward (see FIG. 9D). Then, the rotational force of the second portion 20*b*2 directly causes the transmission of the wheel (left wheel 14*b*) on the corresponding side and causes the forward rotation of the left wheel 14*b*. (At that time, the rotation of the outer ring 34*b*3 of the two-way clutch 34*b* does not cause the rotation of the inner ring 34*b*1.) The rotation of the left wheel 14*b* with the right wheel 14*a* not rotating causes the right turn movement of the wheelchair 10. When attempting to turn left by the left hand, first, only the second portion 20*b*2 of the handrim 20*b* is grasped by the left hand and rotated backward (see FIG. 9D). Then, the rotational force of the second portion 20*b*2 directly causes the transmission of the wheel (left wheel 14*b*) on the corresponding side. (At that time, the rotation of the outer ring 34*b*3 of the two-way clutch 34*b* does not cause the rotation of the inner ring 34*b*1.) The backward rotation of the left wheel 14*b* causes the backward movement and the left turn movement of the wheelchair 10. Then, when both the first portion 20*b*1 and the second portion 20*b*2 of the handrim 20*b* are grasped and rotated forward by the left hand, the wheelchair 10 consequently turns left.

By changing the two portions of the handrims 20*a* and 20*b* by the right and left hands, it is possible to comfortably perform an uphill movement. That is, for example, first, the two portions of the handrims 20*a* and 20*b* are grasped by both hands and rotated forward to perform the uphill movement. When rowing once and then stopping, it is enough to grasp both the first portion 20*a*1 and the second portion 20*a*2 of the handrim 20*a* by the right hand without rotating. Next, the left hand is separated from the first portion 20*b*1 and the second portion 20*b*2 of the handrim 20*b* and returned to the first rowing position, and both the first portion 20*b*1 and the second portion 20*b*2 of the handrim 20*b* are grasped without the rotation by the left hand to keep the stop. Next, the right hand is separated from the first portion 20*a*1 and the second portion 20*a*2 of the handrim 20*a* and returned to the first rowing position, and both the first portion 20*a*1 and the second portion 20*a*2 of the handrim 20*a* are grasped without the rotation by the right hand to keep the stop. While grasping the two portions of the handrims 20*a* and 20*b* by both hands, the handrims are rotated forward to perform the uphill movement. This series of operations is repeated to perform the uphill movement. In this way, by changing the right and left hands and operating, unlike the conventional both-hands-operated wheelchair, it is possible to perform the uphill movement while resting according to the physical strength of the user.

The above is the operation of the wheelchair 10 provided with the two-way clutch 34*a*, but the operation of the wheelchair provided with the one-way clutch 34'*a* (a type in which the forward rotation of the inner ring causes the forward rotation of the outer ring) instead of the two-way clutch 34*a* is as follows.

When attempting to move forward by the right hand, both the first portion 20*a*1 and the second portion 20*a*2 of the handrim 20*a* are grasped by the right hand and rotated forward (see FIG. 9A). Then, a rotational force of the first portion 20*a*1 causes the transmission to the axle 24*a*, the one-way clutch 34'*a*, the rotary shaft 32, the axle 24*b*, and the one-way clutch 34'*b* via the handrim spoke 22*a*, and causes the forward rotation of the right wheel 14*a* and the left wheel 14*b*. At the same time, the rotational force of the second portion 20*a*2 directly causes the transmission to the wheel (right wheel 14*a*) on the corresponding side. (At that time, the forward rotation of the outer ring 34'*a*3 of the one-way clutch 34'*a* does not cause the rotation of the inner ring 34'*a*1.) The forward rotation of the right wheel 14*a* and the left wheel 14*b* causes the wheelchair 10 to move forward.

When attempting to move forward by the left hand, both the first portion 20*b*1 and the second portion 20*b*2 of the handrim 20*b* are grasped by the left hand and rotated forward (see FIG. 9B). Then, the rotational force of the first portion 20*b*1 causes the transmission to the axle 24*b*, the one-way clutch 34'*b*, the rotary shaft 32, the axle 24*a*, and the one-way clutch 34'*a* via the handrim spoke 22*b*, and causes the forward rotation of the right wheel 14*a* and the left wheel 14*b*. At the same time, the rotational force of the second portion 20*b*2 directly causes the transmission to the wheel (left wheel 14*b*) on the corresponding side. (At that time, the forward rotation of the outer ring 34'*b*3 of the one-way clutch 34'*b* does not cause the rotation of the inner ring 34'*b*1.) The forward rotation of the right wheel 14*a* and the left wheel 14*b* causes the wheelchair 10 to move forward.

When attempting to turn left by the right hand, only the second portion 20*a*2 of the handrim 20*a* is grasped by the right hand and rotated forward (see FIG. 9C). Then, the rotational force of the second portion 20*a*2 directly causes the transmission to the wheel (right wheel 14*a*) on the corresponding side and causes the forward rotation of the right wheel 14*a*. (At that time, the forward rotation of the outer ring 34'*a*3 of the one-way clutch 34'*a* does not cause the rotation of the inner ring 34'*a*1.) The rotation of the right wheel 14*a* with the left wheel 14*b* not rotating causes the left turn movement of the wheelchair 10. When attempting to turn right by the right hand, first, only the second portion 20*a*2 of the handrim 20*a* is grasped by the right hand and rotated backward (see FIG. 9C). Then, the rotational force of the second portion 20*a*2 directly causes the transmission to the wheel (right wheel 14*a*) on the corresponding side. (At that time, the backward rotation of the outer ring 34'*a*3 of the one-way clutch 34'*a* causes the backward rotation of the inner ring 34'*a*1.) The backward rotation of the right wheel 14*a* causes the backward movement and the right turn movement of the wheelchair 10. Then, when both the first portion 20*a*1 and the second portion 20*a*2 of the handrim

20*a* are grasped and rotated forward by the right hand, the wheelchair 10 consequently turns right.

When attempting to turn right by the left hand, only the second portion 20*b*2 of the handrim 20*b* is grasped by the left hand and rotated forward (see FIG. 9D). Then, the rotational force of the second portion 20*b*2 directly causes the transmission to the wheel (left wheel 14*b*) on the corresponding side and causes the forward rotation of the left wheel 14*b*. (At that time, the forward rotation of the outer ring 34'*b*3 of the one-way clutch 34'*b* does not cause the rotation of the inner ring 34'*b*1.) The rotation of the left wheel 14*b* with the right wheel 14*a* not rotating causes the right turn movement of the wheelchair 10. When attempting to turn left by the left hand, first, only the second portion 20*b*2 of the handrim 20*b* is grasped by the left hand and rotated backward (see FIG. 9D). Then, the rotational force of the second portion 20*b*2 directly causes the transmission to the wheel (left wheel 14*b*) on the corresponding side. (At that time, the backward rotation of the outer ring 34'*b*3 of the one-way clutch 34'*b* causes the backward rotation of the inner ring 34'*b*1.) The backward rotation of the left wheel 14*b* causes the backward movement and the left turn movement of the wheelchair 10. Then, when both the first portion 20*b*1 and the second portion 20*b*2 of the handrim 20*b* are grasped and rotated forward by the left hand, the wheelchair 10 consequently turns left.

When both the first portion 20*a*1 and the second portion 20*a*2 of the handrim 20*a* are grasped by the right hand and rotated backward, the rotational force of the second portion 20*a*2 directly causes the transmission to the wheel (right wheel 14*a*) on the corresponding side and causes the backward rotation of right wheel 14*a*. (At that time, the backward rotation of the outer ring 34'*a*3 of the one-way clutch 34'*a* causes the backward rotation of the inner ring 34'*a*1. The backward rotation of the inner ring 34'*b*1 of the one-way clutch 34'*b* via the axle 24*a*, the rotary shaft 32, and the axle 24*b* does not cause the rotation of the outer ring 34'*b*3.) The backward rotation of the right wheel 14*a* with the left wheel 14*b* not rotating causes the backward movement and the right turn movement of the wheelchair 10. Further, when both the first portion 20*b*1 and the second portion 20*b*2 of the handrim 20*b* are grasped by the left hand and rotated backward, the rotational force of the second portion 20*b*2 directly causes the transmission to the wheel (left wheel 14*b*) on the corresponding side. (At that time, the backward rotation of the outer ring 34'*b*3 of the one-way clutch 34'*b* causes the backward rotation of the inner ring 34'*b*1. The backward rotation of the inner ring 34'*a*1 of the one-way clutch 34'*a* via the axle 24*b*, the rotary shaft 32, and the axle 24*a* does not cause the rotation of the outer ring 34'*a*3.) The backward rotation of the left wheel 14*b* with the right wheel 14*a* not rotating causes the backward movement and the left turn movement of the wheelchair 10.

In the wheelchair 10 equipped with the one-way clutches 34'*a* and 34'*b*, the backward rotation of the first portions 20*a*1 and 20*b*1 causes the rotation of the inner rings 34'*a*1 and 34'*b*1 but does not cause the rotation of the outer rings 34'*a*3 and 34'*b*3. Therefore, it is not reflected in the operation of the wheelchair 10.

Figure 10A:
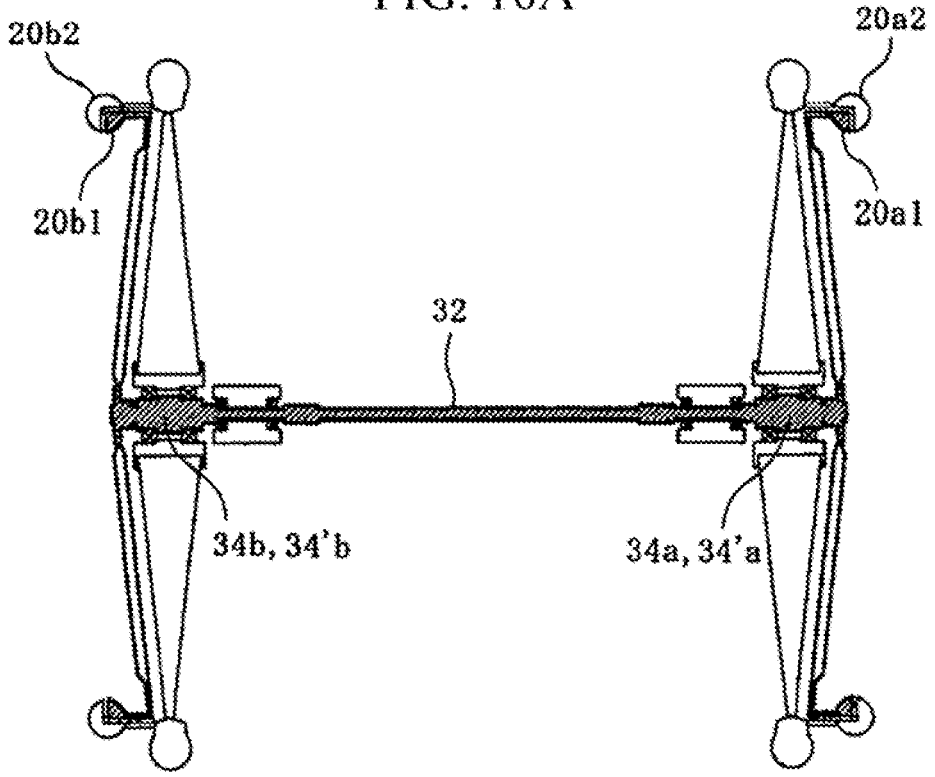
FIGS. 10A and 10B are views showing connection routes of the first portions of the right and left handrims.
Figure 10B:
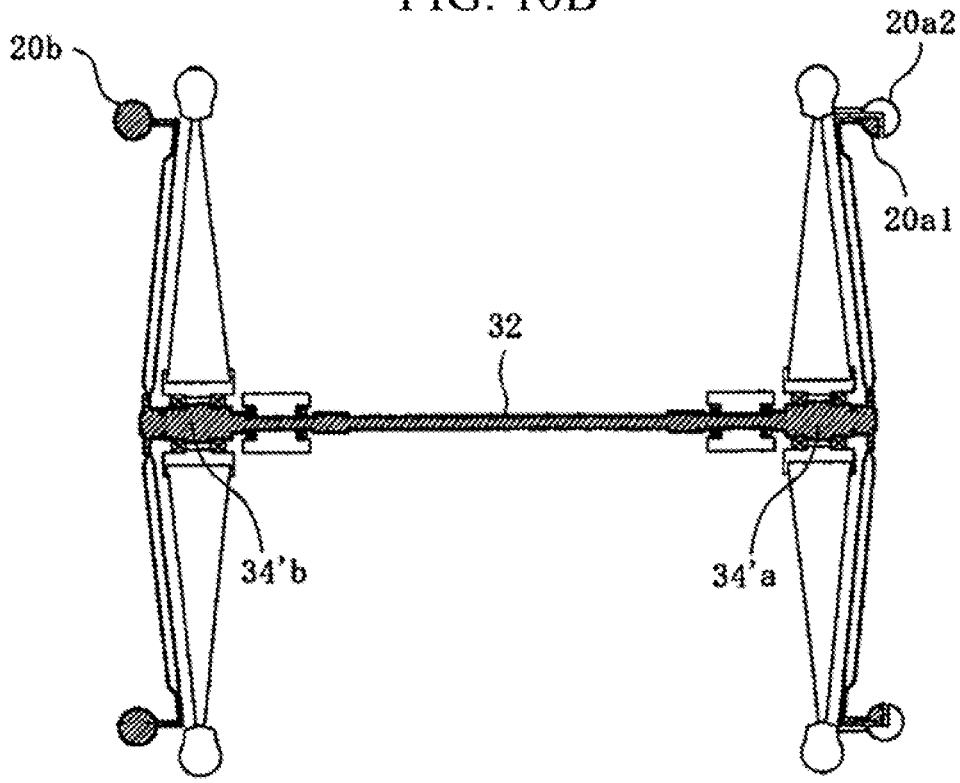

FIG. 10A is a view showing a state in which the first portion 20*a*1 of the handrim 20*a* and the first portion 20*b*1 of the handrim 20*b* are connected by the axle 24*a*, the rotary shaft 32, and the axle 24*b*. FIG. 10B is a view showing a state in which the handrim 20*b* on the other side, which will be described later, is not divided, and is a view a state in which the first portion 20*a*1 of the handrim 20*a* and the handrim 20*b* are connected by the axle 24*a*, the shaft member 32, and the axle 24*b*. In the embodiment shown in FIG. 10A, either the two-way clutch 34*a*, 34*b*, or the one-way clutch 34'*a*, 34'*b* are equipped, but in the embodiment shown in FIG. 10B, one-way clutches 34'*a*, 34'*b* are equipped.

Figure 11:
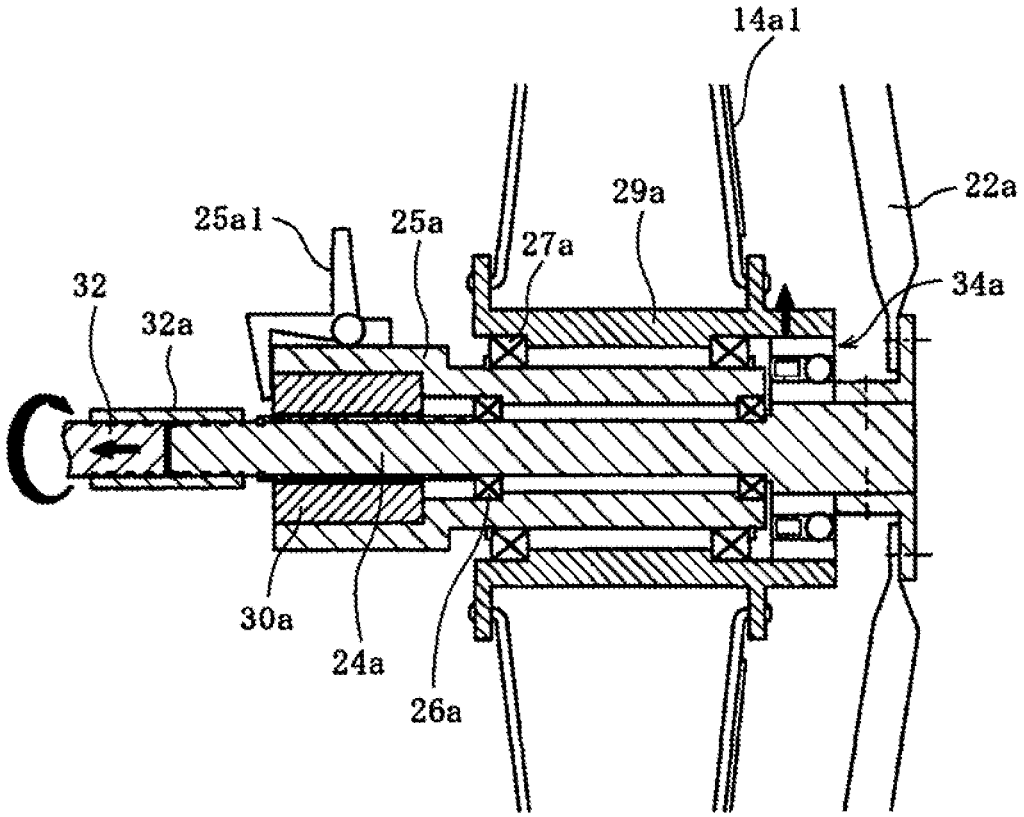
FIG. 11 is a view showing a modified form of the drive mechanism of the wheelchair, corresponding to FIG. 6.

FIG. 11 is a view showing a modified form of the drive mechanism of the wheelchair 10, corresponding to FIG. 6. In the embodiment shown in FIG. 11, the axle 24*a* that supports the right wheel 14*a* is rotatably accommodated in a cylindrical axle support housing 25*a* by a bearing 26*a*, and the axle 24*a* is mounted to the frame 12 via the mounting boss 30*a*. Reference numeral 25*a*1 is a known lever member with an axle fixing spring used for fixing the axle 24*a*.

A cylindrical wheel hub 29*a* is rotatably supported on the shaft support housing 25*a* by a bearing 27*a* disposed on the outer surface of the shaft support housing 25*a*, and the wheel spoke 14*a*1 is connected to the wheel hub 29*a*. The two-way clutch 34*a* is disposed between the outer surface of the axle 24*a* and the inner surface of the wheel hub 29*a*. The one-way clutch 34'*a* may be disposed instead of the two-way clutch 34*a*.

The configuration including the shaft support housing 25*a* is different from the configuration shown in FIGS. 5 and 6, and since the axle 24*a* is supported by the shaft support housing 25*a*, it can be expected to reduce a load due to the rotation of the axle 24*a*.

The wheelchair 10 is equipped with idling mechanisms 36*a* and 36*b*. Here, the idling mechanisms 36*a* and 36*b* are mechanisms for adjusting the rotational play generated when the two-way clutches 34*a* and 34*b* or the one-way clutches 34'*a* and 34'*b* are used. Hereinafter, the idling mechanism 36*a* mounted on the right side portion of the wheelchair 10 will be described, but the idling mechanism 36*b* mounted on the left side portion is also the same as the idling mechanism 36*a*. The rotation of the first portion 20*a*1 of the handrim 20*a* causes the transmission of the rotational force to the right wheel 14*a* via the handrim spoke 22*a* and then the clutches 34*a* and 34'*a*, and causes a time lag until the right wheel 14*a* is rotated. The occurrence of such the time lag is caused by the slight rotational play until the rotational force is transmitted through the clutches 34*a* and 34'*a*. (Such the rotational play is particularly remarkable in the two-way clutch 34*a*. Even in the one-way clutch 34'*a*, an actual starting timing of a rotational load of the first portion 20*a*1 and the second portion 20*a*2 of the handrim 20*a* tends to be different at the initial stage of the movement, and it can be considered that a kind of play can occur.) If such the time lag is left, a rotation starting timing of the rotation of the right wheel 14*a* and the left wheel 14*b* will be slightly different, and as a result, the wheelchair 10 will not go straight and will make an unintended slight turn. Accurate moving control of the wheelchair 10 becomes difficult. The idling mechanism 36*a* is equipped to avoid such a situation. The idling mechanism 36*a* can also be expected to have a secondary effect of reducing the burden on the user's arm. That is, the user is usually forced to perform a motion of grasping and rotating the handrim 20*a*, then once releasing his/her hand from the handrim 20*a*, and swinging back while making an elliptical motion of his/her arm in the vertical plane, which imposes a burden on his/her arm. However, by equipping the idling mechanism 36*a*, it is possible to keep his/her palm resting on a third portion 20*a*3 of the handrim 20*a*, which will be described later. Therefore, it is not necessary to swing his/her arm back and the burden on his/her arm is reduced.

Figure 12A:
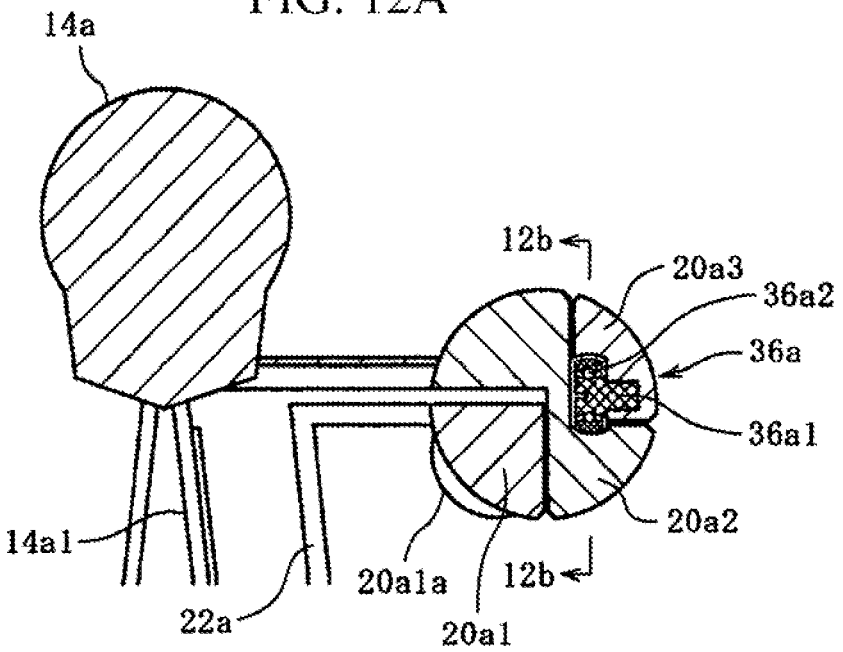
FIGS. 12A, 12B, and 12C are views for explaining an idling mechanism.
Figure 12C:
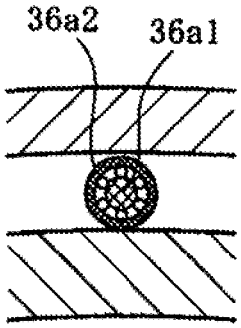
Figure 12B:
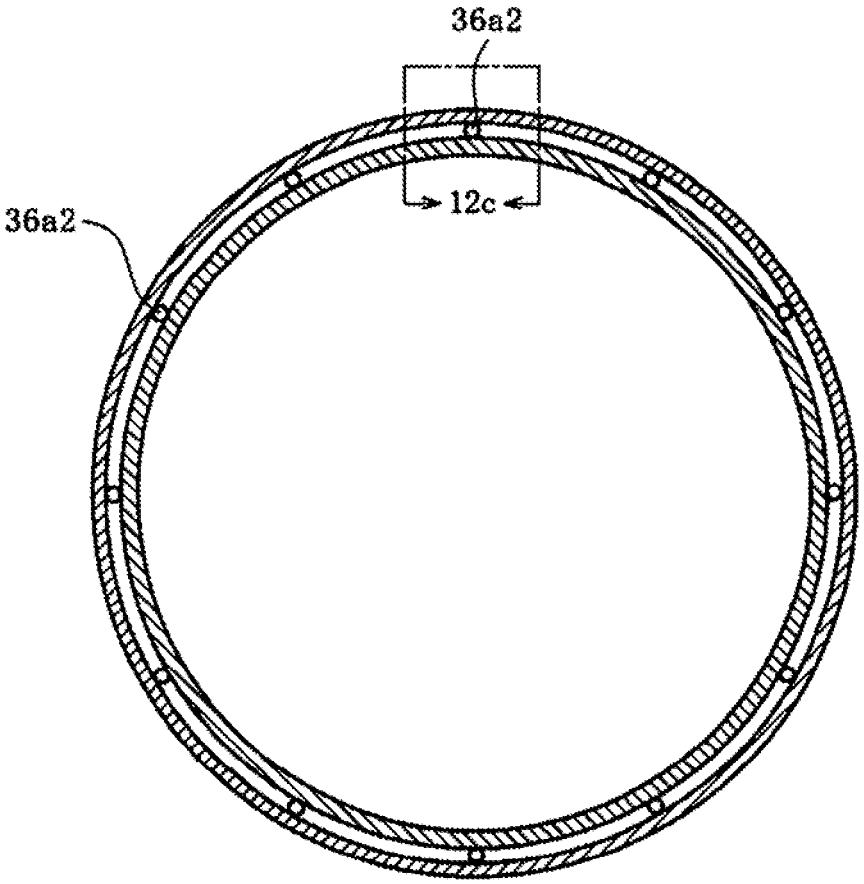

The configuration of the idling mechanism 36*a* will be described with reference to FIGS. 12A, 12B, and 12C. The idling mechanism 36*a* includes the third portion 20*a*3 (see FIG. 12A) disposed separately of the second portion 20*a*2 in the outer upper portion of the circular cross-section of the handrim 20*a*, the shaft member 36*a*1, and rollers 36*a*2 rotatably attached to the shaft member 36*a*1. The idling mechanism 36*a* has a plurality of roller structures disposed at predetermined intervals in the circumferential direction of the handrim 20*a* (see FIG. 12C). As shown in FIG. 12A, the roller structure is housed in the space provided inside the third portion 20*a*3, a lower end of the roller 36*a*2 is in contact with the second portion 20*a*2, and the shaft member 36*a*1 is fixed to the third portion 20*a*3.

When the idling mechanism 36*a* is used, the surface of the third portion 20*a*3 of the handrim 20*a* is covered with the palm, and the first portion 20*a*1 is slightly rotated by an amount of the rotational play while grasping the first portion 20*a*1 with the fingertips. Then by grasping and rotating both the first portion 20*a*1 and the second portion 20*a*2, it is possible to avoid the occurrence of the time lag.

Figure 13A:
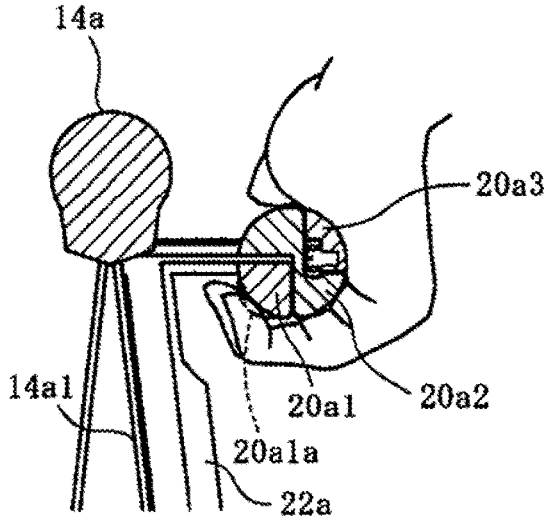
FIGS. 13A,13B,13C, and 13D are views showing a state in which the handrim provided with the third portion is grasped by the right hand, corresponding to FIGS. 4A and 4B.
Figure 13B:
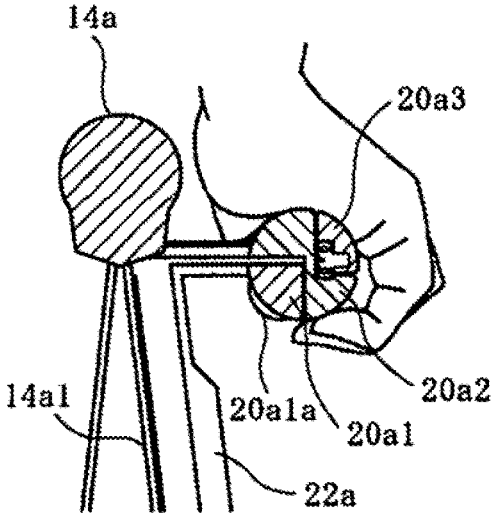
Figure 13C:
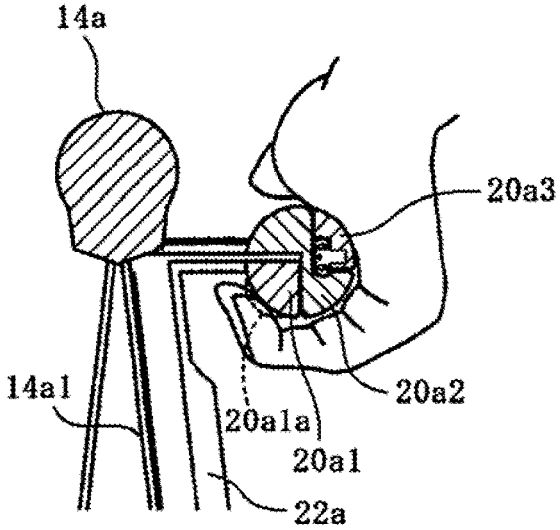
Figure 13D:
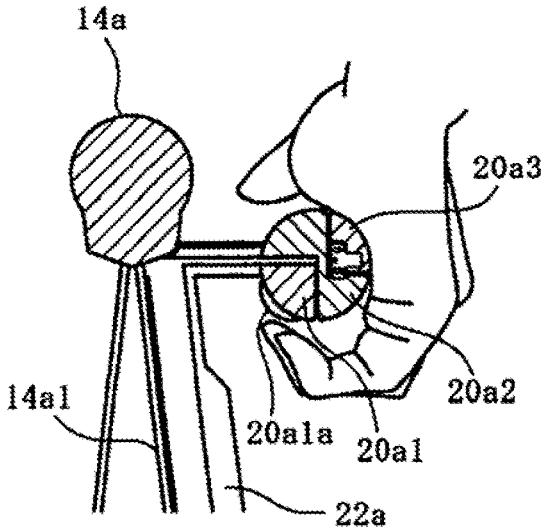
Figure 14A:
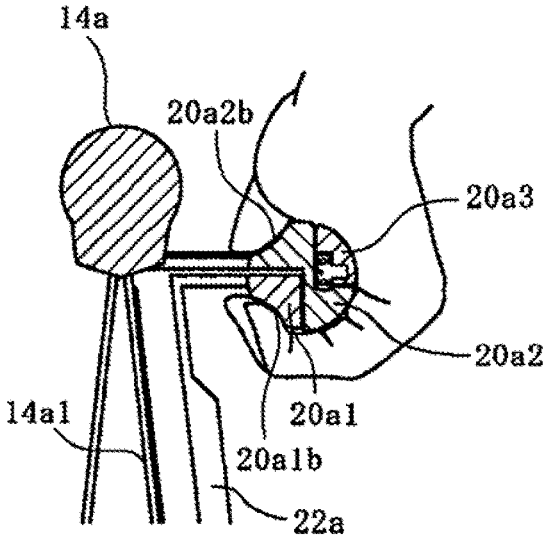
FIGS. 14A,14B,14C, and 14D are views showing a state in which the handrim provided with a recess instead of a convex portion is grasped by the right hand, corresponding to FIGS. 13A to 13D.
Figure 14B:
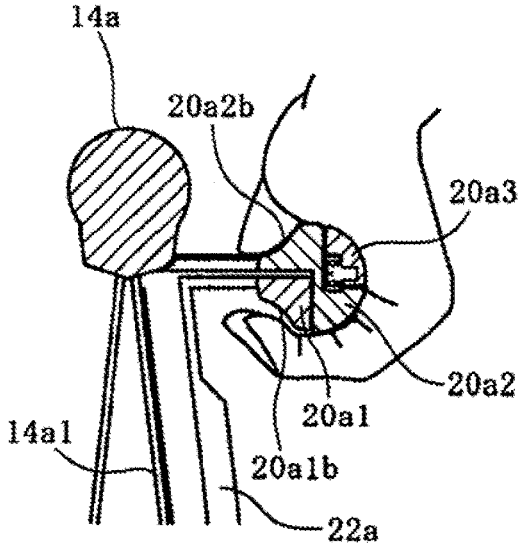
Figure 14C:
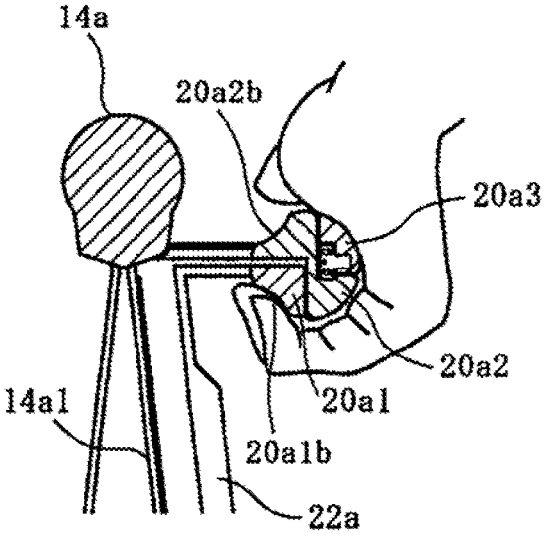
Figure 14D:
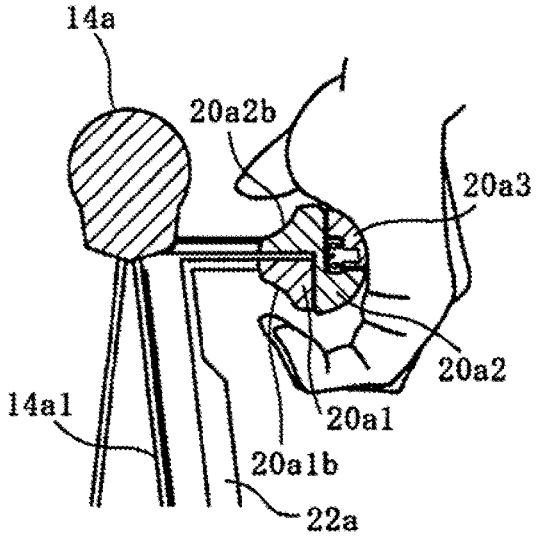

FIGS. 13A to 13D are views showing states of grasping the handrim 20*a* having the third portion 20*a*3, corresponding to FIGS. 4A and 4B. That is, FIG. 13A shows a state in which an outer surface of the third portion 20*a*3 is covered with the palm, the first portion 20*a*1 is grasped by the fingertip of the right hand, and the second portion 20*a*2 is grasped by the thumb of the right hand. FIG. 13B shows a state in which the outer surface of the third portion 20*a*3 is covered with the palm and the second portion 20*a*2 is grasped by the fingertip of the right hand, FIG. 13C shows a state in which the outer surface of the third portion 20*a*3 covered with the palm and the portion 20*a*1 is grasped by the fingertip of the right hand, and FIG. 13D shows a state in which only the outer surface of the third portion 20*a*3 is covered with the palm.

In FIGS. 13,13B,13C, and 13D, a convex portion 20*a*1*a* is provided on the first portion 20*a*1 of the handrim 20*a*, but the recess may be provided instead of the convex portion 20*a*1*a*. FIGS. 14A to 14D are respectively views corresponding to FIGS. 13A to 13D in which the recess 20*a*1*b* is provided in the first portion 20*a*1 and the recess 20*a*2*b* is provided in the second portion 20*a*2.

Figure 15A:
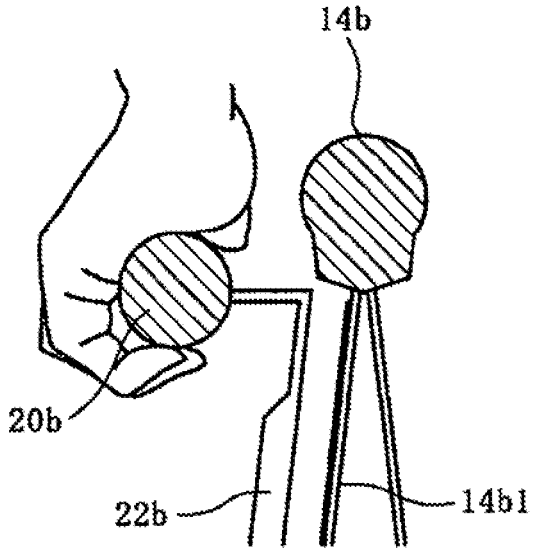
FIGS. 15A, 15B, and 15C are views showing a modified form of the handrim.
Figure 15B:
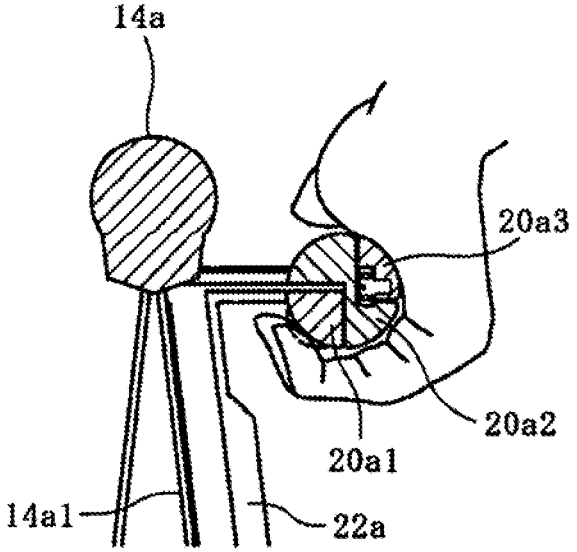
Figure 15C:
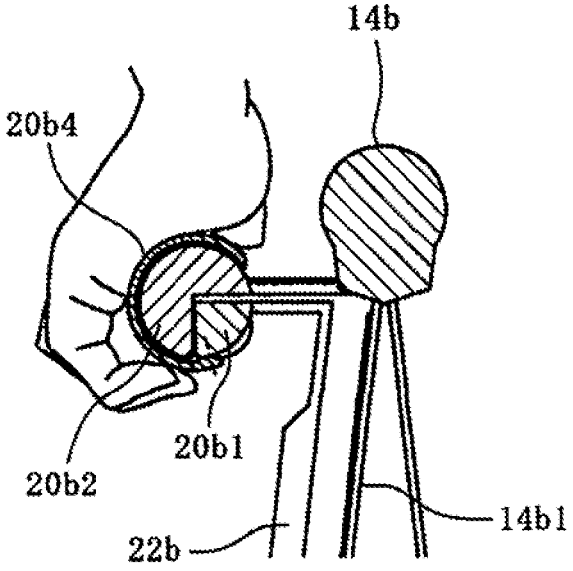

FIGS. 15A and 15C are views showing a modified form of the handrim. In FIG. 15A, the left handrim 20*b* is not provided with the first to the third portions. (Therefore, the left handrim 20*b* performs the same function as the first portion 20*a*1 of the right handrim 20*a*.) In FIG. 15B, corresponding to the left handrim, the right handrim 20*a* is provided with the first portion 20*a*1, the second portion 20*a*2, and the third portion 20*a*3. This form of the left handrim 20*b* is useful for users who have one hand paralyzed and the other hand not paralyzed, but for the reasons described below, one-way clutches 34'*a*, 34'*b* are provided. In the case of a user whose right hand is healthy and whose left hand is paralyzed, the left handrim 20*b* can be grasped by the left hand being paralyzed, and the right-hand 20*a* can be grasped by the healthy right hand to perform the desired operation. That is, the first portion 20*a*1 and the second portion 20*a*2 of the handrim 20*a* are rotated forward to perform return operation from the grasping state of FIG. 13A to the grasping state of FIG. 13C. Thereby the left handrim 20*b* is returned. By repeating this operation, the wheelchair 10 moves forward, and at that time, the left handrim 20*b* also repeats the forward rotation and the backward rotation, so that when the handrim 20*b* is grasped by the paralyzed left hand, the rehabilitation training of the left hand is performed. In the wheelchair 10 equipped with the two-way clutches 34*a* and 34*b* instead of the one-way clutches 34*a*' and 34*b*' when the first portion 20*a*1 of the handrim 20*a* is rotated backward, the wheelchair 10 moves backward and returns to the original position so that it is not suitable for such use.

In FIG. 15C, the left handrim 20*b* is divided into two portions, a first portion 20*b*1 and a second handrim 20*b*2, but by covering the entire outer surface of the left handrim 20*b* with a predetermined attachment 20*b*4, the handrim can be used as an undivided handrim.

In the above description, the right side portion of the wheelchair 10 has been described, but the left side portion is the same as the right side portion.

It is needless to say that the present invention is not limited to the above-described embodiments, various modifications can be made within the scope of the invention described in the claims, and these are also included in the scope of the present invention.

For example, the details of the components of the wheelchair shown are merely exemplary and these details may be modified.

Description of the Reference Numerals

10 wheelchair
12 frame
14*a*, 14*b* wheel
14*a*1, 14*b*1 wheel spoke
16*a*, 16*b* caster
18 sheet
20*a*, 20*b* handrim
20*a*1, 20*b*1 first portion
20*a*2, 20*b*2 second portion
20*a*3, 20*b*3 third portion
20*b*4 attachment
22*a*, 22*b* handrim spoke
24*a*, 24*b* axle
25*a*, 25*b* shaft support housing
26*a*, 26*b* bearing
27*a*, 27*b* bearing
28*a*, 28*b* axle holder
29*a*, 29*b* wheel hub
30*a*, 30*b* mounting boss
32 rotary shaft
32*a*, 32*b* connection sleeve
34*a*, 34*b* two-way clutch
34*a*1, 34*b*1 inner ring
34*a*2, 34*b*2 bearing
34*a*3, 34*b*3 outer ring
34*a*4, 34*b*4 roller
34*a*5, 34*b*5 cage
34'*a*, 34'*b* one-way clutch
34'*a*1, 34'*b*1 inner ring
34'*a*2, 34'*b*2 bearing
34'*a*3, 34'*b*3 outer ring
34'*a*4, 34'*b*4 cam
34'*a*5, 34'*b*5 spring
36*a*, 36*b* idling mechanism
36*a*1, 36*b*1 shaft member
36*a*2, 36*b*2 roller

What is claimed is:

1. A wheelchair having a frame, a right wheel and a left wheel, a right caster and a left caster, a seat, and a pair of right and left circular cross-sectional handrims concentrically disposed with an axle of each wheel, the wheelchair comprising:

each of the handrims formed as separate bodies, and having a first portion located at an inner lower portion of the circular cross-section and a second portion occupying a portion other than the first portion of the circular cross-section;

the first portion connected to the handrim spoke;

the second portion connected to a base of each wheel; and a drive mechanism for transmitting a first rotational force generated by the first portion of the handrim on one side and/or another side to the wheel on the one side and the wheel on the other side, wherein a second rotational force generated by the second portion of the handrim on the one side and/or the other side is transmitted to the wheel on the corresponding side, the drive mechanism has the axle on the one side connected to the handrim spoke on the one side, the axle on the other side connected to the axle on the one side via a rotary shaft and connected to the handrim spoke on the other side, a first two-way clutch disposed on the axle on the one side, and a second two-way clutch disposed on the axle on the other side, the first two-way clutch is configured to transmit the first rotational force to the wheel on the one side and is not configured to transmit the second rotational force generated by the second portion of the handrim on the one side to the axle on the one side, and the second two-way clutch is configured to transmit the first rotational force to the wheel on the other side and is not configured to transmit the second rotational force generated by the second portion of the handrim on the other side to the axle on the other side.

2. The wheelchair according to claim 1, wherein an idling mechanism for adjusting a rotational play generated during the use of the first two-way clutch and/or the second two-way clutch is provided, the idling mechanism has a third portion disposed as a separate body from the second portion at an outer upper portion of a circular cross-section of the handrim, and a plurality of roller structures disposed at predetermined intervals in a circumferential direction of the handrim, and the roller structure is composed of a shaft member and a roller rotatably attached to the shaft member and is housed in the space provided inside the third portion with the lower end of the roller in contact with the second portion and the shaft member fixed to the third portion.

3. A wheelchair having a frame, a right wheel and a left wheel, a right caster and a left caster, a seat, and a pair of right and left circular cross-sectional handrims concentrically disposed with an axle of each wheel, the wheelchair comprising:

each of the handrims formed as separate bodies, and having a first portion located at an inner lower portion of the circular cross-section and a second portion occupying a portion other than the first portion of the circular cross-section;

the first portion connected to the handrim spoke;

the second portion connected to a base of each wheel; and a drive mechanism for transmitting a first rotational force generated by the first portion of the handrim on one side and/or another side to the wheel on the one side and the wheel on the other side, wherein a second rotational force generated by the second portion of the handrim on the one side and/or the other side is transmitted to the wheel on the corresponding side, the drive mechanism has the axle on the one side connected to the handrim spoke on the one side, the axle on the other side connected to the axle on the one side via a rotary shaft and connected to the handrim spoke on the other side, a first one-way clutch disposed on the axle on the one side, and a second one-way clutch disposed on the axle on the other side, the first one-way clutch is configured to transmit only the forward rotational force of the first rotational force to the wheel on the one side, and is configured to transmit only the backward rotational force of the second rotational force generated by the second portion of the handrim on the one side to the axle on the one side, and the second one-way clutch is configured to transmit only the forward rotational force of the first rotational force to the wheel on the other side and is configured to transmit only the backward rotational force of the second rotational force generated by the second portion of the handrim on the other side to the axle on the other side.

4. The wheelchair according to claim 3, wherein an idling mechanism for adjusting a rotational play generated during the use of the first one-way clutch and/or the second one-way clutch is provided, the idling mechanism has a third portion disposed as a separate body from the second portion at an outer upper portion of a circular cross-section of the handrim, and a plurality of roller structures disposed at predetermined intervals in a circumferential direction of the handrim, and the roller structure is composed of a shaft member and a roller rotatably attached to the shaft member and is housed in the space provided inside the third portion with the lower end of the roller in contact with the second portion and the shaft member fixed to the third portion.

5. A wheelchair having a frame, a right wheel and a left wheel, a right caster and a left caster, a seat, and a pair of right and left circular cross-sectional handrims concentrically disposed with an axle of each wheel, the wheelchair comprising:

the handrim on one side formed as separate bodies, and having a first portion located at an inner lower portion of the circular cross-section and a second portion occupying a portion other than the first portion of the circular cross-section;

the first portion and the handrim on another side connected to the handrim spoke;

the second portion connected to a base of the wheel on the one side; and a drive mechanism for transmitting a first rotational force generated by the first portion of the handrim on the one side and/or by the handrim on the other side to the wheel on the one side and the wheel on the other side, wherein a second rotational force generated by the second portion of the handrim on the one side is transmitted to the wheel on the one side, the drive mechanism has the axle on the one side connected to the handrim spoke on the one side, the axle on the other side connected to the axle on the one side via a rotary shaft and connected to the handrim spoke on the other side, a first one-way clutch disposed on the axle on the one side, and a second one-way clutch disposed on the axle on the other side, the first one-way clutch is configured to transmit only the forward rotational force of the first rotational force to the wheel on the one side, and is configured to transmit only the backward rotational force of the second rotational force generated by the second portion of the handrim on the one side to the axle on the one side, and the second one-way clutch is configured to transmit only the forward rotational force of the first rotational force to the wheel on the other side.

6. The wheelchair according to claim 5, wherein an idling mechanism for adjusting a rotational play generated during the use of the first one-way clutch and/or the second one-way clutch is provided, the idling mechanism has a third portion disposed as a separate body from the second portion at an outer upper portion of a circular cross-section of the handrim, and a plurality of roller structures disposed at predetermined intervals in a circumferential direction of the handrim, and the roller structure is composed of a shaft member and a roller rotatably attached to the shaft member and is housed in the space provided inside the third portion with the lower end of the roller in contact with the second portion and the shaft member fixed to the third portion.

* * * * *